US006636712B2

(12) United States Patent
Shimaoka

(10) Patent No.: US 6,636,712 B2
(45) Date of Patent: Oct. 21, 2003

(54) PROCESS UNIT AND IMAGE FORMING DEVICE HAVING AN INTER-AXIS DISTANCE REGULATION MECHANISM

(75) Inventor: Takashi Shimaoka, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/950,141

(22) Filed: Sep. 10, 2001

(65) Prior Publication Data

US 2002/0071693 A1 Jun. 13, 2002

(30) Foreign Application Priority Data

Sep. 11, 2000 (JP) ..... 2000-275290

(51) Int. Cl.[7] ..... G03G 15/00; G03G 15/04; G03G 21/18

(52) U.S. Cl. ..... 399/113; 399/119; 399/126

(58) Field of Search ..... 399/113, 119, 399/126, 279, 286

(56) References Cited

U.S. PATENT DOCUMENTS 4,339,196 A * 7/1982 Beck et al. ..... 399/119
4,410,259 A * 10/1983 Yamagata et al. ..... 399/286 X
4,951,093 A * 8/1990 Ishii et al. ..... 399/119
5,089,849 A * 2/1992 Hiraoka ..... 399/119
5,258,811 A * 11/1993 Miyake et al. ..... 399/279 X

FOREIGN PATENT DOCUMENTS

JP 10-222042 A 8/1998
JP 2000-105502 A 4/2000

* cited by examiner

*Primary Examiner*—Fred L. Braun
(74) *Attorney, Agent, or Firm*—Frishauf, Holtz, Goodman & Chick, P.C.

(57) ABSTRACT

A process unit for use in an image forming apparatus includes a drum section containing a photosensitive drum and a drum frame for rotatably supporting the drum, and a developing section containing a developing roller and a roller frame for rotatably supporting the roller. The drum frame and roller frame are coupled so that a mutual distance between the outer peripheral surfaces of the drum and roller is set in an adjustable manner. The process unit further includes an inter-axis distance regulation mechanism provided on one of the drum frame and roller frame in a movable manner by which the mechanism is movable between multiple stages, thereby adjusting the mutual distance in the multiple stages. The mechanism includes a rotation type regulation member which has a plurality of contact surface sites whose distances from a rotation center are different in a radial direction with respect to the rotation center.

35 Claims, 7 Drawing Sheets

PROCESS UNIT AND IMAGE FORMING DEVICE HAVING AN INTER-AXIS DISTANCE REGULATION MECHANISM

CROSS-REFERENCE TO RELATED APPLICATIONS

This application is based upon and claims the benefit of priority from the prior Japanese Patent Application No. 2000-275290, filed Sep. 11, 2000, the entire contents of which are incorporated herein by reference.

BACKGROUND OF THE INVENTION

1. Field of the Invention

The present invention relates to a process unit, an image formation device provided with the same, and a color image formation device with the same.

2. Description of the Related Art

An image formation device using an electrophotographic method which has a conveyor for conveying a sheet of recording paper and an image formation mechanism for forming a desired image on a sheet of the recording paper being conveyed by the conveyor using an electrophotographic method is well known and is widely used as what is called a copying machine or a printer. The above-described image formation mechanism essentially includes a rotating photosensitive drum, a charger for charging an outer peripheral surface of this photosensitive drum, an exposure device for forming a desired electrostatic latent image on the charged outer peripheral surface, a developing device for developing the electrostatic latent image on the outer peripheral surface of the photosensitive drum by toner to form a toner image, a transfer device for transferring the toner image formed on the outer peripheral surface of the photosensitive drum to a sheet of the recording paper conveyed by the conveyor and a cleaner for removing toner remaining on the outer peripheral surface of the photosensitive drum after transferring a toner image from the outer peripheral surface of the photosensitive drum to a sheet of the recording paper being conveyed.

In the case where the developing device uses a developing roller, the developing roller is disposed with respect to the photosensitive drum so that the respective rotation center lines of the developing roller and the photosensitive drum are parallel with each other and both of them are directed in the same direction. Then, between the mutual adjacent portions of the outer peripheral surface of the developing device and the outer peripheral surface of the photosensitive drum, for example, a space and contact depth having the predetermined dimensions is provided according to image formation conditions such as, for example, a kind of toner, an image formation speed (developing speed) and the like. The predetermined dimensions of the space and the contact depth are values by which the best image quality is obtained according to the image formation conditions.

In the above-described kind of image formation device in prior art, one independent process unit is constituted by combining a photosensitive drum and a developing device together. In a greater detail, the rotation center axis of the photosensitive drum is supported in a freely rotatable manner by the photosensitive drum frame and the photosensitive drum section is constituted by the photosensitive drum frame with the photosensitive drum. Moreover, the rotation center axis of the developing roller of the developing device is supported in a freely rotatable manner by a developing roller frame, and the developing device section is constituted by the developing roller frame with the developing device including the developing roller. Then, photosensitive drum frame and the developing roller frame are combined so that the mutual distance between the photosensitive drum frame and the developing roller is changeable.

In the photosensitive drum frame and the developing roller frame which are combined with each other, the positions of the photosensitive drum and the developing roller are adjusted so as to be in a state where the respective rotation center lines are parallel to each other and directed in the same direction.

Then, before such a process unit is incorporated into the image formation device, the distance is set and fixed in the process unit according to the image formation conditions required in its image formation device.

In manufacturing of the conventional process unit, the setting work for the distance is troublesome. Therefore, after the distance has been set at a predetermined value and fixed, the work for changing it to another value has also been troublesome.

Therefore, in manufacturing of the conventional process unit, after the above distance in the process unit has been set and fixed according to the image formation conditions required in the image formation device in which the process unit is incorporated, it has been hardly ever carried out that the distance was changed to another value.

Therefore, when a rapid demand variation among a variety of image information devices has occurred, it has been difficult to apply a process unit for another image formation device having a large stock to the image formation device whose demand is rapidly increased. As a result it has been difficult to deal with the rapid increase of a demand for one device, and it has also been difficult to reduce the stock of the process unit for the other image formation device having a large stock.

The present invention has been achieved under the circumstances, and an object of the present invention is to provide a process unit capable of easily and rapidly performing the change of the mutual distance between the photosensitive drum and the developing roller for various kinds of image formation devices having different image formation conditions.

A further object of the present invention is to provide an image formation device and a similar color image formation device whose economical values are enhanced by being provided with such a process unit.

BRIEF SUMMARY OF THE INVENTION

In order to achieve the object of the present invention as described above, a process unit according to the present invention comprises:

a photosensitive drum section including a photosensitive drum having a rotation center axis and an outer peripheral surface, and a photosensitive drum frame for supporting the rotation center axis of the photosensitive drum in a rotatable manner;

a developing device section which includes a developing roller having a rotation center axis and an outer peripheral surface, and a developing roller frame for supporting a rotation center axis of the developing roller in a rotatable manner, in which the developing roller frame and the photosensitive drum frame are coupled so that the mutual distance between the outer peripheral surface of the developing roller and the outer peripheral surface of the photosensitive drum is set in an adjustable manner as well as these are disposed so that the rotation center axis of the developing roller is parallel with the rotation center axis of the photosensitive drum from each other and directed in the same direction with respect to the rotation center axis of the photosensitive drum in a state where the developing roller is made located adjacent to the photosensitive drum; and an inter-axis distance regulation mechanism which is provided in either of the photosensitive drum frame of the photosensitive drum section and the developing roller frame of the developing device section in a movable manner by which the inter-axis distance regulation mechanism is movable between multiple stages, which is in contact with the predetermined other position of the photosensitive drum and the developing roller frame and which can adjust a mutual distance between the outer peripheral surface of the developing roller and the outer peripheral surface of the photosensitive drum in multiple stages by its moving to the one of them in multiple stages.

In order to achieve the object of the present invention as described above, an image formation device according to the present invention comprises:

a conveyor for conveying a sheet of recording paper;

a photosensitive drum section including a photosensitive drum having a rotation center axis and an outer peripheral surface and a photosensitive drum frame for supporting the rotation center axis of the photosensitive drum in a rotatable manner;

a charger for charging the outer peripheral surface of the photosensitive drum, an exposure device for forming a desired electrostatic latent image on the charged outer peripheral surface of the photosensitive drum;

a developing device section which includes a developing roller having a rotation center axis and an outer peripheral surface and a developing roller frame for supporting a rotation center axis of the developing roller in a rotatable manner, in which the developing roller frame and the photosensitive drum frame are coupled so that a mutual distance between the outer peripheral surface of the developing roller and the outer peripheral surface of the photosensitive drum in an adjustable manner as well as these are disposed so that the rotation center axis of the developing roller is in parallel to the rotation center axis of the photosensitive drum and is directed in the same direction with respect to the rotation center axis of the photosensitive drum in a state where the developing roller is made located adjacent to the photosensitive drum and which develops an electrostatic latent image on the outer peripheral surface of the photosensitive drum using toner by the developing roller and forms a toner image;

an inter-axis distance regulation mechanism which is provided in either of the photosensitive drum frame of the photosensitive drum section and the developing roller frame of the developing device section in a movable manner by which the inter-axis distance regulation mechanism is movable between multiple stages, which is in contact with the predetermined other position of the photosensitive drum and the developing roller frame and which can adjust the mutual distance between the outer peripheral surface of the developing roller and the outer peripheral surface of the photosensitive drum in multiple stages by its moving to the one of them in multiple stages;

a transfer device for transferring the toner image formed on the outer peripheral surface of the photosensitive drum to a sheet of the recording paper being conveyed by the conveyor; and a cleaner for removing toner remaining on the outer peripheral surface of the photosensitive drum after transferring a toner image from the outer peripheral surface of the photosensitive drum to a sheet of the recording paper being conveyed.

In order to achieve the object of the present invention as described above, a color image formation device according to the present invention comprises:

a conveyor for conveying a sheet of recording paper; and image formation units which are disposed in multiple number of positions along a conveyance path of a sheet of the recording paper being conveyed by the conveyor and which form a desired color image on a sheet of the recording paper being conveyed by the conveyor, respectively, each of the multiple image formation units is provided with, a photosensitive drum section including a photosensitive drum having a rotation center axis and an outer peripheral surface, and a photosensitive drum frame for supporting the rotation center axis of the photosensitive drum in a rotatable manner;

a charger for charging the outer peripheral surface of the photosensitive drum, an exposure device for forming a desired electrostatic latent image on the charged outer peripheral surface of the photosensitive drum;

a developing device section which includes a developing roller having a rotation center axis and an outer peripheral surface and a developing roller frame for supporting a rotation center axis of the developing roller in a rotatable manner, in which the developing roller frame and the photosensitive drum frame are coupled so that a mutual distance between the outer peripheral surface of the developing roller and the outer peripheral surface of the photosensitive drum in an adjustable manner as well as which is disposed so that the rotation center axis of the developing roller is in parallel to the rotation center axis of the photosensitive drum and is directed in the same direction with the rotation center axis of the photosensitive drum in a state where the developing roller is made located adjacent to the photosensitive drum and which develops an electrostatic latent image on the outer peripheral surface of the photosensitive drum using the desired color toner by the developing roller and forms the desired color toner image;

an inter-axis distance regulation mechanism which is provided in either of the photosensitive drum frame of the photosensitive drum section and the developing roller frame of the developing device section in a movable manner by which the inter-axis distance regulation mechanism can be movable between multiple stages, which is in contact with the predetermined other position of the photosensitive drum frame and the developing roller frame and which can adjusts the mutual distance between the outer peripheral surface of the developing roller and the outer peripheral surface of the photosensitive drum in multiple stages by its moving to the one of them in multiple stages;

a transfer device for transferring the desired color toner image formed on the outer peripheral surface of the photosensitive drum to the sheet of the recording paper being conveyed by the conveyor; and a cleaner for removing the desired color toner remaining on the outer peripheral surface of the photosensitive drum after transferring the desired color toner image from the outer peripheral surface of the photosensitive drum to the sheet of the recording paper being conveyed.

BRIEF DESCRIPTION OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

Hereinafter, a process unit according to various embodiments of the present invention, a variety of inter-axis distance regulation mechanisms for use in these various process units, and an image formation device and a color image formation device using a variety of process units will be described in detail below with reference to the appended drawings.

DETAILED DESCRIPTION OF THE INVENTION

Figure 1:
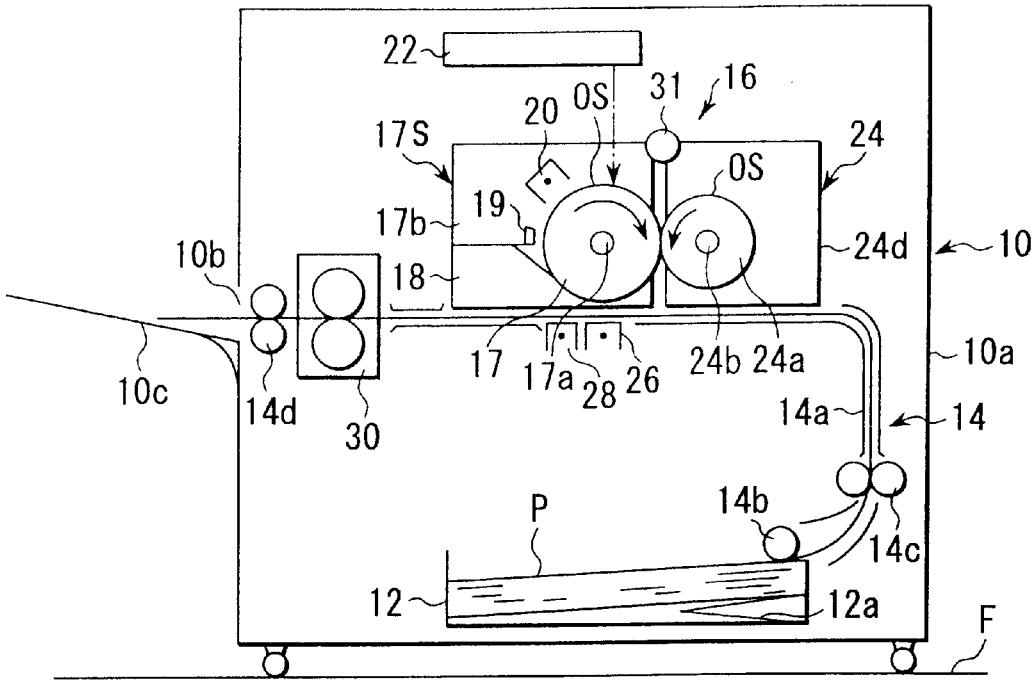
FIG. 1 is a vertical sectional view schematically showing an image formation device provided with a process unit according to a first embodiment of the present invention.

FIG. 1 schematically shows a vertical sectional view of an image formation device 10 provided with a process unit according to a first embodiment of the present invention. An outer housing 10*a* of the image formation device 10 is placed on a floor F of a building. A paper supplying cassette 12 is attachably and detachably disposed in the outer housing 10*a* at the predetermined position in the vicinity of the floor F. The paper supplying cassette 12 stores plural sheets of recording paper P of a predetermined size and shape in a stacked state. In the paper supplying cassette 12, urging means 12*a* for upwardly urging one end portion of plural sheets of the recording paper P in the stacked state is provided.

In the outer housing 10*a*, from the one end portion of the paper supplying cassette 12, a paper conveyance path 14*a* extends upwardly along the one of the side wall of the outer housing 10*a*. The paper conveyance path 14*a* further extends approximately horizontally toward the other side wall of the outer housing 10*a* above the paper supplying cassette 12 in the intermediate portion in the vertical direction within the outer housing 10*a*, and reaches to an opening 10*b* formed on the other side wall. On the outer surface of the other side wall, a paper discharging tray 10*c* is disposed immediately below the opening 10*b*.

One end portion of the upper surface of the uppermost positioned sheet of recording paper in plural sheets of the recording paper P in the stacked state being urged toward the upward in the paper supplying cassette 12 as described above is in contact with a pickup roller 14*b*.

A pair of recording paper supplying rollers 14*c* are disposed with the paper conveyance path 14*a* between them at the lower end of the recording paper conveyance path 14*a*. On the upper end portion of the paper carrying path 14*a*, a pair of recording paper discharging rollers 14*d* are disposed with the paper conveyance path 14*a* between them. On the intermediate portion between the lower portion and the upper portion of the paper conveyance path 14*a*, multiple pairs of recording paper conveying rollers (not shown) are disposed with the paper conveyance path 14*a* between them.

When rotating the pickup roller 14*b* one turn, a sheet of the recording paper at the uppermost position out of plural sheets of the recording paper P in the stacked state in the paper supplying cassette 12 is sent to a pair of the recording paper supplying rollers 14*c* on the lowermost portion of the paper transfer path 14*a* by the pickup roller 14*b*. The pair of recording paper supplying rollers 14*c* send a sheet of the recording paper from the paper supplying cassette 12 to the intermediate portion of the paper conveyance path 14*a*. A sheet of the recording paper in the intermediate portion of the paper conveyance path 14*a* is carried toward the pair of recording paper discharging rollers 14*d* on the upper end portion of the paper conveyance path 14*a* by the multiple pairs of recording paper conveying rollers. The pair of recording paper discharging rollers 14*d* discharge a sheet of the recording paper reached on the upper end portion of the paper conveyance path 14*a* on a paper discharging tray 10*c* adjacent to the opening 10*b* on the upper wall via the opening 10*b* of the upper wall of the armored housing 10*a*.

As is clear from the description described above, in the present embodiment, the paper conveyance path 14*a*, a pair of recording paper supplying rollers 14*c* located on the lower end portion of the paper conveyance path 14*a*, the multiple pairs of recording paper conveying rollers (not shown) of the intermediate portion of the paper conveyance path 14*a*, and a pair of recording paper discharging rollers 14*d* located on the upper end portion of the paper conveyance path 14*a* configures the conveyor 14 for conveying a sheet of the recording paper P upwardly in the outer housing 10*a*.

Furthermore, the image formation mechanism 16 for forming a desired image by the electrophotographic method on a sheet of the recording paper being conveyed upward along the paper conveyance path 14*a* by the conveyor 14 is stored in the outer housing 10*a*. The image formation mechanism 16 is disposed along the horizontally extending portion of the intermediate portion of the paper conveyance path 14*a*.

In the present embodiment, the image formation mechanism 16 is provided with a photosensitive drum 17 disposed adjacent to the paper conveyance path 14*a* on the upper side of the horizontally extending portion of the intermediate portion of the paper conveyance path 14*a*. The photosensitive drum 17 is rotated so that the moving direction of the portion adjacent to the paper conveyance path 14*a* on its outer peripheral surface is matched with the moving direction of a sheet of the recording paper at the portion of the paper conveyance path 14*a* to which the photosensitive drum 17 is adjacent, the moving speed of a sheet of the recording paper on the paper conveyance path 14*a* is set so as to be matched with the rotation speed of the outer peripheral surface of the photosensitive drum 17.

Furthermore, the image formation mechanism 16 includes a cleaner 18, a discharger 19, a charger 20, an exposure device 22 and a developing device section 24 which are disposed on the upper side of the horizontally extending part of the intermediate portion of the paper conveyance path 14*a*, and which are disposed toward the direction from the upstream side to the downstream side of the outer peripheral surface, adjacent to the outer peripheral surface and around the outer peripheral surface of the photosensitive drum 17. The arrangement order of the cleaner 18, the discharger 19, the charger 20, the exposure device 22 and the developing device section 24 is in accordance with the rotation direction of the outer peripheral surface.

The image formation mechanism 16 further includes a transfer device 26 disposed on the lower side of the horizontally extending part of the intermediate portion of the paper conveyance path 14*a* and adjacent to the outer peripheral surface of the photosensitive drum 17 and a separation device 28 disposed on the lower side and on the downstream side of the transfer device 26 in the moving direction of a sheet of the recording paper in the middle of the paper conveyance path 14*a*.

In the outer housing 10*a*, a fixing device 30 is further disposed on the downstream side of the image formation mechanism 16 in the moving direction of a sheet of the recording paper in the middle of the paper conveyance path 14*a* along the horizontally extending part of the intermediate portion of the paper conveyance path 14*a*.

In the image formation device 10 according to the present embodiment configured as described above, in order to form the desired image on a sheet of the recording paper, the photosensitive drum 17 is rotated at the predetermined speed in the predetermined direction as well as a sheet of the recording paper is sent to the paper conveyance path 14*a* from the paper supplying cassette 12 by the pickup roller 14*b*. During that time period, the charger 20 uniformly electrically charges the outer peripheral surface of the photosensitive drum 17. The exposure device 22 forms the desired electrostatic latent image corresponding to the desired image on the uniformly charged outer peripheral surface of the photosensitive drum 17. The developing device section 24 develops an electrostatic latent image on the outer peripheral surface of the photosensitive drum 17 by toner and forms a toner image. The transfer device 26 transfers the toner image from the outer peripheral surface of the photosensitive drum 17 to a sheet of the recording paper which has been conveyed toward the outer peripheral surface of the photosensitive drum 17 in the middle of the paper conveyance path 14*a*. The separation device 28 separates a sheet of the recording paper, on which the toner image has been transferred, from the outer peripheral surface of the photosensitive drum 17. The fixing device 30 fixes the transferred toner image on a sheet of the recording paper reached at the fixing device 30 on a sheet of the recording paper in the middle of the paper conveyance path 14*a* after separating a sheet of the recording paper from the outer peripheral surface of the photosensitive drum 17. The sheet of the recording paper to which the toner image corresponding to the desired image is fixed is discharged on the sheet of paper discharging tray 10*c* on the upper wall of the outer housing 10*a* by a pair of sheet of paper discharging rollers 14*d* of the horizontally extending end portion of the conveyor 14.

As for the photosensitive drum 17 whose toner image on the outer peripheral surface is transferred to a sheet of the recording paper in the transfer device 26, its remaining toner remaining on the outer peripheral surface is removed by the cleaner 18. Next, as for the outer peripheral surface of the photosensitive drum 17, its remaining charge remaining on the outer peripheral surface is discharged by the discharger 19, and is made to be prepared for the next image formation.

Next, the configuration around the photosensitive drum 17 and the configuration of the developing device section 24 will be described below with reference to FIG. 2 in addition to FIG. 1.

Both ends of a rotation center axis 17*a* of the photosensitive drum 17 are supported in a rotatable manner by a bearing 17*c* provided in the photosensitive drum frame 17*b*. On the outer projecting areas from the bearings 17*c* on the outer peripheral surfaces of the both end portions, snap rings 17*d* for preventing the both end portions from falling from the bearings 17*c* are detachably fixed.

The rotation center axis 17*a* of the photosensitive drum 17 is connected to a rotation drive source (not shown) via a rotation drive force transmission mechanism (not shown) in the outer housing 10*a*, and is rotated at the predetermined rotation speed in the predetermined direction when the rotation force is transferred from the rotation drive source (not shown).

A photosensitive drum section 17S is configured by at least the photosensitive drum 17 and the photosensitive drum frame 17*b*. In the present embodiment, the cleaner 18, the discharger 19 and the charger 20 are also supported by the photosensitive drum 17.

The developing device section 24 includes a developing roller 24*a* and a developing roller frame 24*d* supporting both end portions of the rotation center axis 24*b* of the developing roller 24*a* in a rotatable manner via bearings 24*c*. On the outer peripheral surfaces of the both end portions, snap rings 24*e* for preventing the both end portions from falling from the bearings 24*c* are detachably fixed in the outer projecting areas from the bearings 24*c*.

The rotation center axis 24 of the developing roller 24*a* is also connected to the rotation drive source (not shown) via the rotation drive force transmission mechanism (not shown) in the outer housing 10*a*, and is rotated at the predetermined speed in the predetermined direction when the rotation force is transferred from the rotation drive source (not shown). It should be noted that as for the rotation direction of the predetermined rotation speed of the developing roller 24*a*, the peripheral velocity of the outer peripheral surface OS of the developing roller 24*a* is set at the same speed with the peripheral velocity on the outer peripheral surface OS of the photosensitive drum 17.

The developing roller frame 24*d* has a toner storage chamber 24*f* adjacent to the developing roller 24*a*. In the toner storage chamber 24*f*, a toner stirring member (not shown) connected to the rotation drive source (not shown) via the rotation drive force transmission mechanism (not shown) is housed as well as the developing roller 24*a*. When the developing roller 24*a* is rotated at the predetermined rotation speed in the predetermined direction, the toner stirring member (not shown) is also rotated and it supplies the toner in the toner storage chamber 24*f* toward the developing roller 24*a*. Furthermore in the toner storage chamber 24*f*, a toner thickness regulation/charging blade 24*g* is housed. The toner thickness regulation/charging blade 24*g* is in contact with the toner attached on the outer peripheral surface of the developing roller 24*a* by the toner stirring member (not shown), and the attached toner having the predetermined thickness and charged by the predetermined charges, being carried toward to the outer peripheral surface OS of the photosensitive drum 17 by the outer peripheral surface of the developing roller 24*a*.

As to the photosensitive drum frame 17*b* of the photosensitive drum section 17S and the developing roller frame 24*d* of the developing device section 24, while the photosensitive drum 17 and the developing roller 24*b* are disposed so that each outer peripheral surface OS of them is adjacent to each other, the photosensitive drum frame 17*b* of the photosensitive drum section 17S and the developing roller frame 24*d* of the developing device section 24 are coupled each other so that the rotation center axis 17*a* of the photosensitive drum 17 and the rotation center axis 24*b* of the developing roller 24*a* are made in parallel to each other to be directed in the same direction, the outer peripheral surface OS of the photosensitive drum 17 and the outer peripheral surface OS of the developing roller 24*a* are coupled and the mutual distance (space or contact depth) S between the outer peripheral surface OS of the photosensitive drum 17 and the outer peripheral surface OS of the developing roller 24*a* is adjustable.

Figure 2:
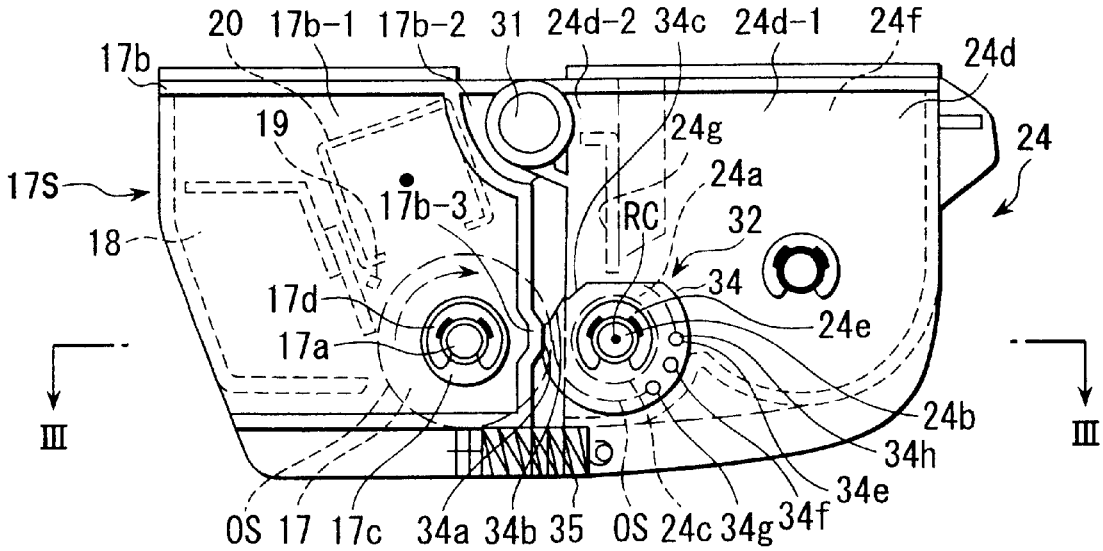
FIG. 2 is an enlarged front view showing the enlarged elevation of the process unit of FIG. 1.
Figure 3:
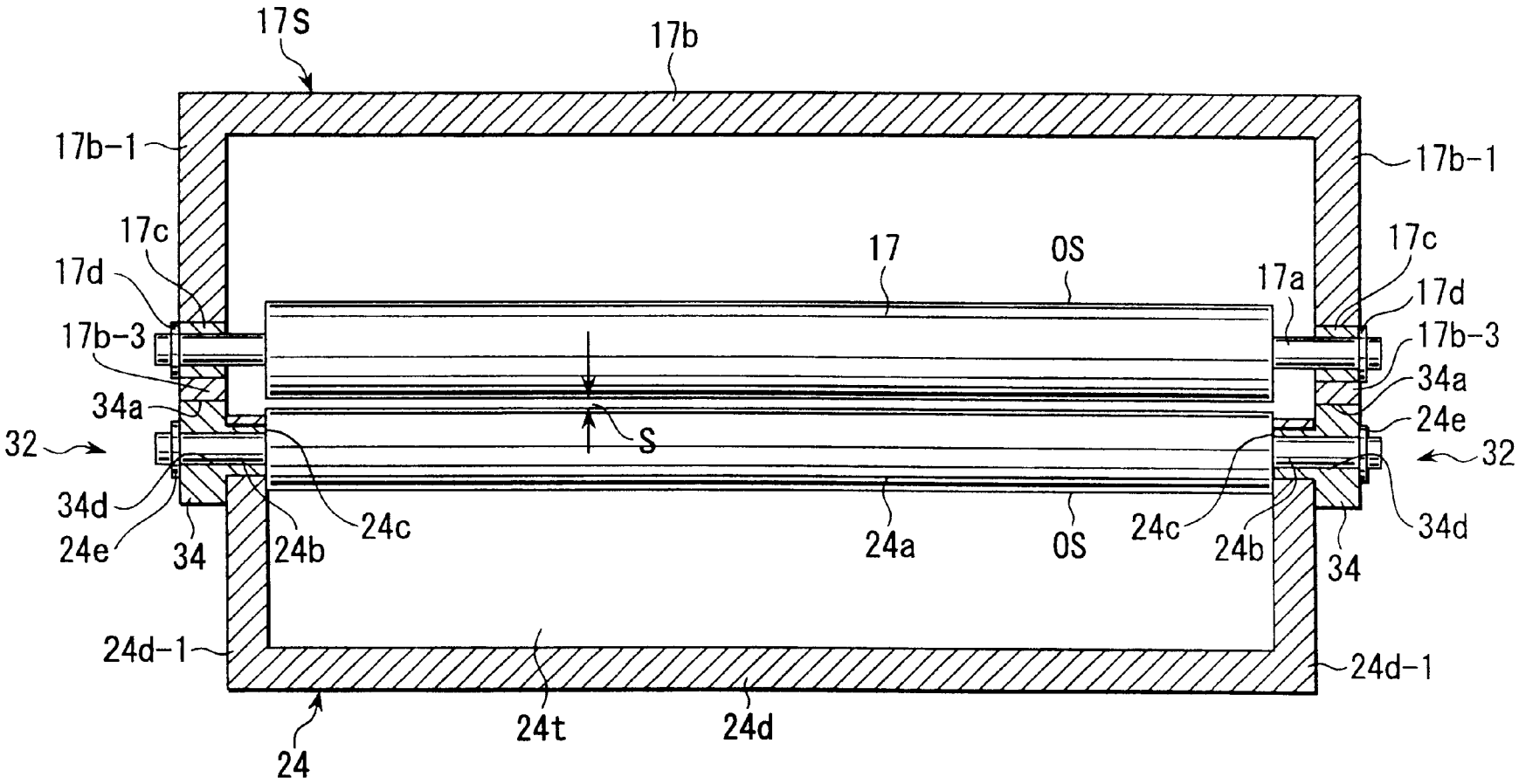
FIG. 3 is a horizontal sectional view taken along the III—III line of the process unit of FIG. 2.

In more detail, referring to the FIG. 3 in addition to FIG. 2, the distance between two side walls 17*b*-1 for supporting the rotation center axis 17*a* of the photosensitive drum 17 in a freely rotatable manner in the photosensitive drum frame 17*b*, is set slightly larger than the distance between two side walls 24*d*-1 for supporting the rotation center axis 24*b* of the developing roller 24*a* in the developing roller frame 24*d*. Then, the portion located at the predetermined distance apart from the rotation center axis 17*a* of the photosensitive drum 17 in the upper direction on the two side walls 17*b*-1 of the photosensitive drum frame 17*b* forms a coupling piece 17*b*-2 projecting toward the portion located at the predetermined distance apart upwardly from the rotation center axis 24*b* of the developing roller 24*a* on the two side walls 24*d* of the adjacent developing roller frame 24*b*, and the portion located at the predetermined distance apart upwardly from the rotation center axis 24*b* of the developing roller 24*a* on the two side walls 24*d*-1 of the developing roller frame 24*d* forms a coupling piece 24*d*-2 projecting toward to the portion located at the predetermined distance apart upwardly from the rotation center axis 24*b* of the photosensitive drum 17 on the two side walls 17*b*-1 of the adjacent photosensitive drum 17*b*.

The coupling piece 17*b*-2 of the two side walls 17*b*-1 of the photosensitive drum frame 17*b* and the coupling piece 24*d*-2 of the two side walls 24*d*-1 of the developing roller frame 24*d* overlap each other. These coupling pieces 17*b*-2, 24*d*-2 are coupled by a coupling axis 31 directing toward to the same direction in a relatively rotatable manner as well as the coupling axis 31 is in parallel to the rotation center axis 17*a* of the photosensitive drum 17 and the rotation center axis 24*b* of the developing roller 24*a*.

Specifically, the photosensitive drum frame 17*b* and the developing roller frame 24*d* are coupled each other through the coupling axis 31 located in the upper portion, and are in a relatively rotatable manner around the coupling axis 31. Therefore, since the distance from the center line of the coupling axis 31 to the center line of the rotation center axis 17*a* of the photosensitive drum 17 on the photosensitive drum frame 17*b* is set as being identical with the distance from the center line of the coupling axis 31 to the center line of the rotation center axis 24*b* of the developing roller 24*a* on the developing roller frame 24*d*, when the photosensitive drum frame 17*b* and the developing roller frame 24*d* are rotated around the coupling axis 31 in a relatively rotatable manner, the mutual distance (space or contact depth) S between the outer peripheral surface OS of the photosensitive drum 17 and the outer peripheral surface OS of the developing roller 24*a* can be adjusted. And during this adjusting work, the rotation center axis 17*a* of the photosensitive drum 17 and the rotation center axis 24*b* of the developing roller 24*a* can be kept in a state where these are in parallel to each other and directed in the same direction.

On either of the photosensitive frame 17*b* of the photosensitive drum section 17S and the developing roller frame 24*d* of the developing device section 24 which is in contact with the other predetermined position of either of the photosensitive drum frame 17*b* and the developing roller frame 24*d*, an inter-axis distance regulation mechanism 32 which can adjust the mutual distance between the outer peripheral surface OS of the developing roller 24*a* and the outer peripheral surface OS of the photosensitive drum 17 in multiple stages is provided. The inter-axis distance regulation mechanism 32 can adjust the distance S by its moving to the one of them in multiple stages.

Next, the inter-axis distance regulation mechanism 32 will be described in detail below with reference to FIG. 4A and FIG. 4B in addition to FIG. 2 and FIG. 3.

The inter-axis distance regulation mechanism 32 is provided in a rotatable manner by which the inter-axis distance regulation mechanism 32 is rotatable between multiple stages on one of the photosensitive drum frame 17*b* and the developing roller frame 24*d*, and is provided with a rotation type inter-axis distance regulation member 34 having a plurality of contact surface sites 34*a*, 34*b* and 34*c* whose distances from a rotation center RC are different in the radial direction with respect to the rotation center RC of themselves.

In more detail, the rotation type inter-axis distance regulation member 34 is combined and fixed with one of the bearings 24*c* for supporting both end portions of the rotation center axis 24*b* of the developing roller 24*a* in a freely rotatable manner, and includes an opening 34*d* into which one end portion of the rotation center axis 24*b* inserted into the bearing 24*c* is inserted. Therefore, when the opening 34*d* of the rotation type inter-axis distance regulation member 34 as well as the bearing 24*c* is fitted on one end portion corresponding thereto in the both end portions of the rotation center axis 24*b* of the developing roller 24*a*, the rotation type inter-axis distance regulation member 34 rotates around the center of the opening 34*d* as the rotation center RC on the end portion corresponding thereto in the both end portions of the rotation center axis 24*b* of the developing roller 24*a* on the two side walls 24*d*-1 of the developing roller frame 24*d*. The falling of the rotation type inter-axis distance regulation member 34 from the corresponding one of the both end portions of the rotation center axis 24*b* of the developing roller 24*a* is prevented by the snap ring 24*e* fixed on the outer projecting part of the corresponding one of the both end portions of the rotation center axis 24*b* inserted into the opening 34*d* of the rotation type inter-axis distance regulation member 34.

A plurality of contact surface sites 34*a*, 34*b* and 34*c* of the rotation type inter-axis distance regulation member 34 are configured by a plurality of concentric circles with respect to the rotation center RC as well as these are apart from each other in a circumferential direction with respect to the rotation center of themselves (i.e., center of the opening 34*d*) RC.

On the rotation type inter-axis distance regulation member 34, a plurality of positioning holes 34*e*, 34*f* and 34*g* are formed to locate on the directly opposite sides to the respective contact surface sites 34*a*, 34*b* and 34*c* with respect to the rotation center RC on the straight line connecting between the respective contact surface sites 34*a*, 34*b* and 34*c* and the rotation center RC. A plurality of the positioning holes 34*e*, 34*f* and 34*g* are positioned on one circle a center of which is coincident with the rotation center RC of the rotation type inter-axis distance regulation member 34.

On the respective two side walls 24*d*-1 of the developing roller frame 24*d*, a positioning pin 34*h* is fixed at the predetermined position on the circle on which the plurality of the positioning holes 34*e*, 34*f* and 34*g* draw are arranged when the rotation type inter-axis distance regulation member 34 is rotated on the end portion corresponding thereto in the both end portions of the rotation center axis 24*b* of the developing roller 24*a*. When the positioning pin 34*h* is inserted into any one of multiple positioning holes 34*e*, 34*f* and 34*g* and the positioning pin 34*h* is fixed on the side wall 24*d*-1 corresponding thereto on the developing roller frame 24*d*, any one of the contact surface sites 34*a*, 34*b* and 34*c* corresponding to any one of the plurality of positioning holes 34*e*, 34*f* and 34*g* into which the positioning pin 34*h* is inserted via the straight line on each of the two side walls 22*d*-1 of the developing roller frame 24*d* is in contact with the predetermined site 17*b*-3 of each of the end surfaces on the two side walls 17*b*-1 of the photosensitive drum frame 17*b*.

In order to stably keep the contact of any one of the contact surface sites 34*a*, 34*b* and 34*g* of the rotation type inter-axis distance regulation member 34 on each of the respective two side walls 24*d*-1 of the developing roller frame 24*d* with respect to the predetermined site 17*b*-3 of each of the end surfaces of the two side walls 17*b*-1 of the photosensitive drum frame 17*b* without generating the gap, the two side walls 17*b*-1 of the photosensitive drum frame 17*b* and the two side walls 24*d*-1 of the developing roller frame 24*d* are urged so as to be approaching each other. In the present embodiment, the urging is performed by a tension coil spring 35 spanning between the lower end portion of each of the two side walls 17*b*-1 of the photosensitive drum frame 17*b* and the lower end portion of each of the two side walls 24*d*-1 of the developing roller frame 24*d*.

Specifically, in the inter-axis distance regulation mechanism 32 configured as described above, the rotation type inter-axis distance regulation member 34 can be rotated between the rotation positions of the multiple stages corresponding to the number of the plurality of the positioning holes 34*e*, 34*f* and 34*g* by changing the positioning hole into which the positioning pin 34*h* is inserted in the plurality of the positioning holes 34*e*, 34*f* and 34*g* of the rotation type inter-axis distance regulation member 34 on the respective two side walls 24*d*-1 of the developing roller frame 24*d*. As a result, one of the contact surface site 34*a*, 34*b* or 34*c* of the rotation type inter-axis distance regulation member 34 on each of the two side walls 24*d*-1 of the developing roller frame 24*d* which contacts with the predetermined site 17*b*-3 of each of the end surfaces of the two side walls 17*b*-1 of the photosensitive drum frame 17*b* is changed. This means that the mutual rotation distance between the photosensitive drum frame 17*b* and the developing roller frame 24*d* centering around the coupling axis 31 can be easily changed in multiple stages by the number of a plurality of the positioning holes 34*e*, 34*f* and 34*g*, and further, this means that the mutual distance S (space or contact depth) between the outer peripheral surface OS of the photosensitive drum 17 supported by the photosensitive drum frame 17*b* and the outer peripheral surface OS of the developing roller 24*a* supported by the developing roller frame 24*d* can be easily changed in multiple stages by the number of the plurality of the positioning holes 34*e*, 34*f* and 34*g*.

It should be noted that in the embodiment, the inter-axis distance regulation mechanism 32 has the rotation type inter-axis distance regulation members 34 on the both end portion of the rotation center axis 24*b* of the developing roller 24*a* on the two side walls 24*d*-1 of the developing roller frame 24*d*, and a predetermined site 17*b*-3 with which any one of the multiple contact surface sites 34*a*, 34*b* and 34*c* of each of the rotation type inter-axis distance regulation members 34 is in contact is provided on each of the end surfaces of the two side walls 17*b*-1 of the photosensitive drum frame 17*b*.

However, according to the invention of the present application, the inter-axis distance regulation mechanism 32 can be also functioned as similarly to the inter-axis distance regulation mechanism 32 shown in FIG. 2 through FIG. 4B by providing the rotation type inter-axis distance regulation members 34 in a rotatable manner by which the rotation type inter-axis distance regulation members 34 can be rotatable between the rotation positions of multiple stages on the two side walls 24*d*-1 of the developing roller frame 24*d* excepting on the both end portions of the rotation center axis 24*b* of the developing roller 24*a*, and by making any one of the respective multiple contact surface sites 34*a*, 34*b* and 34*c* of each of the rotation type inter-axis distance regulation members 34 being in contact with the predetermined site 17*b*-3 of each of the respective end surfaces of the two side walls 17*b*-1 of the photosensitive drum frame 17*b*.

Moreover, according to the invention of the present application, the inter-axis distance regulation mechanism 32 can be also functioned as similarly to the inter-axis distance regulation mechanism 32 shown in FIG. 2 through 4B by providing the rotation type inter-axis distance regulation members 34 on the both end portions of the rotation center axis 17*a* of the photosensitive drum 17 in a rotatable manner by which each inter-axis distance regulation member 34 can be rotatable between the rotation positions of the multiple stages on the two side walls 17*b*-1 of the photosensitive drum frame 17*b*, by making each of the rotation type inter-axis distance regulation members 34 being rotatable among the rotation positions of the multiple stages, and by configuring the predetermined site with which any one of the multiple contact surface sites 34*a*, 34*b* and 34*c* of each of the rotation type inter-axis distance regulation members 34 is in contact is provided on each of the end surfaces of the two side walls 24*d*-1 of the developing roller frame 24*d*.

Even in this case, the inter-axis distance regulation mechanism 32 can be functioned as similarly to the inter-axis distance regulation mechanism 32 shown in FIG. 2 through FIG. 4B by providing the rotation type inter-axis distance regulation members 34 in a rotatable manner by which each inter-axis distance regulation member 34 can be rotatable between the rotation positions of the multiple stages on the two side walls 17*b*-1 of the photosensitive drum frame 17*b* excepting for both end portions of the rotation center axis 17*a* of the photosensitive drum 17, by making the rotation type inter-axis distance regulation member 34 rotatable among the rotation positions of the multiple stages, and by configuring the predetermined site with which any one of the multiple contact surface sites 34*a*, 34*b* and 34*c* f each of the rotation type inter-axis distance regulation member 34 is in contact is provided on each of the end surfaces of the two side walls 24*d*-1 of the developing roller frame 24*d*.

Furthermore, the inter-axis distance regulation mechanism can be also functioned as similarly to the inter-axis distance regulation mechanism 32 shown in FIG. 2 through FIG. 4B, provided that it satisfies the items described as follows, by providing one rotation type inter-axis distance regulation member 34 in a rotatable manner by which the regulation member 34 can be rotated between the rotation positions of the multiple stages only on either of one of the two side walls 17*b*-1 of the photosensitive drum frame 17*b* or one of the two side walls 24*d*-1 of the developing roller frame 24*d*, by making the rotation type inter-axis distance regulation member 34 being rotatable among the rotation positions of the multiple stages, and by configuring the predetermined position with which any one of the multiple contact surface sites 34*a*, 34*b* and 34*c* of the rotation type inter-axis distance regulation member 34 is in contact on either of one of the two side walls 24*d*-1 of the developing roller frame 24*d* or one of the other end surfaces of the two side walls 17*b*-1 of the photosensitive drum frame 17*b*.

The above-described items are that the rigidities of the photosensitive drum frame 17*b* and the developing roller frame 24*d* are large, and the mutual parallel arrangement between the rotation center axis 17*a* of the photosensitive drum 17 and the rotation center axis 24*b* of the developing roller 24*a* and the correspondence of extending directions of them are kept while both of the photosensitive drum frame 17*b* and the developing roller frame 24*d* are rotated around the coupling axis 31 even by using only one rotation type inter-axis distance regulation member 34.

Still furthermore, the rotation type inter-axis distance regulation mechanism can be also functioned as similarly to the inter-axis distance regulation mechanism 32 shown in FIG. 2 through FIG. 4B, provided that it satisfies the items described above, by providing the rotation type inter-axis distance regulation member 34 on either of the portion in the developing roller frame 24*d* excepting for the two side walls 24*d*-1 and the portion in the photosensitive drum frame 17*b* excepting for the two side walls 17*b*-1, by making the rotation type inter-axis distance regulation member 34 being rotatable between the rotation positions of the multiple stages, and by providing the predetermined position with which any one of the multiple contact surface sites 34*a*, 34*b* and 34*c* of the rotation type inter-axis distance regulation member 34 is in contact only on either of the portion in the photosensitive drum frame 17*b* excepting for the two side walls 17*b*-1 and the portion in the developing roller frame 24 dexcepting for the two side walls 24*d*-1, when the rotation type inter-axis distance regulation member 34 is rotated between the rotation positions of the multiple stages.

Figure 4B:
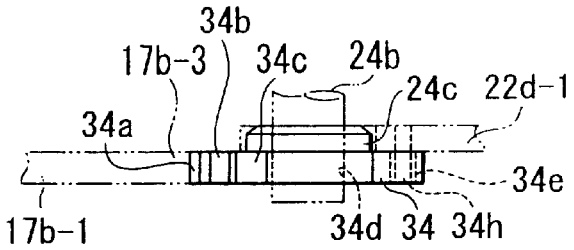
FIG. 4B is an enlarged plan view showing the enlarged inter-axis distance regulation mechanism of FIG. 4.
Figure 5B:
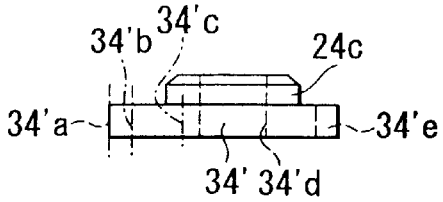
FIG. 5B is an enlarged front view showing the enlarged elevation of the first modification of the inter-axis distance regulation mechanism of FIG. 5A.
Figure 4A:
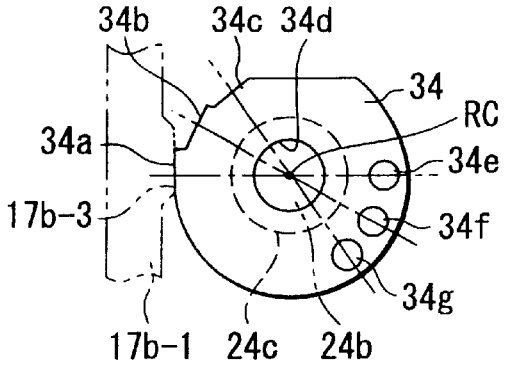
FIG. 4A is an enlarged front view showing the enlarged elevation of an inter-axis distance regulation mechanism of a process unit of FIG. 2.
Figure 5A:
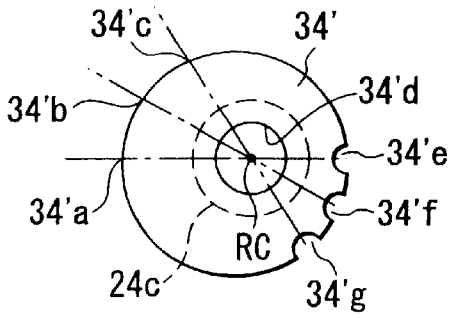
FIG. 5A is an enlarged side view showing the enlarged side elevation of a first modification of an inter-axis distance regulation mechanism of the process unit of FIG. 2.

In FIG. 5A and FIG. 5B, an enlarged front view and a plane view of the first modification of the rotation type inter-axis distance regulation member 34 of the inter-axis distance regulation mechanism 32 shown in FIG. 2 through FIG. 4B are shown.

The rotation type inter-axis distance regulation member 34' of the first modification also includes the opening 34'*d* combined with the bearing 24*c* similarly to the rotation type inter-axis distance regulation member 34 of the first embodiment, and has a plurality of contact surface sites 34'*a*, 34'*b* and 34'*c* configured by one circle eccentric to the rotation center RC of itself which is the center of the opening 34'*d*. Specifically, the plurality of the contact surface sites 34'*a*, 34'*b* and 34'*c* are configured on one continuous and curved surface, however, the distances from the rotation center RC in the radial direction with respect to the rotation center RC are different from each other.

As further referring to the rotation type inter-axis distance regulation member 34', the multiple positioning concave places 34'*e*, 34'*f* and 34'*g* are formed on the directly opposite sides to the multiple contact surface sites 34'*a*, 34'*b* and 34'*c* with respect to the rotation center RC on the straight lines connecting the respective multiple contact surface sites 34'*a*, 34'*b* and 34'*c* with the rotation center RC. The multiple positioning concave places 34'*e*, 34'*f* and 34'*g* are positioned on one circle a center of which is coincident with the rotation center RC of the rotation type inter-axis distance regulation member 34'.

In the inter-axis distance regulation mechanism 32 shown in FIG. 2 and FIG. 3, even in the case where the rotation type inter-axis distance regulation member 34' shown in FIG. 5A and FIG. 5B is used instead of the rotation type inter-axis distance regulation member 34 shown in FIG. 4A and FIG. 4B, the inter-axis distance regulation mechanism 32 can be functioned as similarly to the case where the rotation type inter-axis distance regulation member 34 is used shown in FIGS. 4A and 4B is used.

Specifically, by changing the positioning concave place into which the positioning pin 34*h* is inserted for the purpose of fixing, among the multiple positioning concave places 34'*e*, 34'*f* and 34'*g* of the rotation type inter-axis distance regulation member 34' on the respective two side walls 22*d*-1 of the developing roller frame 24*d*, the rotation type inter-axis distance regulation member 34' can be rotated between the rotation positions of the multiple stages by the number of the multiple positioning concave places 34'*e*, 34'*f* and 34'*g*. As a result, one of the contact surface sites 34'*a*, 34'*b* and 34'*c* of each of the rotation type inter-axis distance regulation members 34' on the two side walls 22*d*-1 of the developing roller frame 24*d* which is in contact with the predetermined site 17*b*-3 of each of the end surfaces of the two side walls 17*b*-1 of the photosensitive drum frame 17*b* is changed. This means that the mutual rotation distance between the photosensitive drum frame 17*b* and the developing roller frame 24*d* can be easily changed in multiple stages by the number of the multiple positioning concave places 34'*e*, 34'*f* and 34'*g*, and further this means that the mutual distance (space or contact depth) S between the outer peripheral surface OS of the photosensitive drum 17 supported by the photosensitive drum frame 17*b* and the outer peripheral surface OS of the developing roller 24*a* supported by the developing roller frame 24*d* can be easily changed in the multiple stages by the number of the multiple positioning concave places 34'*e*, 34'*f* and 34'*g*.

Figure 6B:
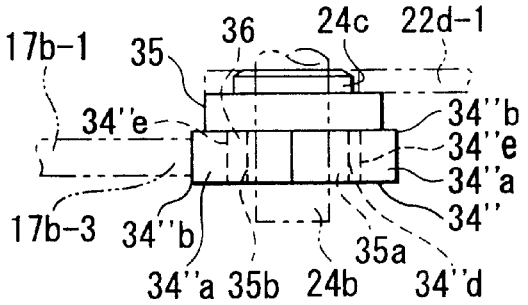
FIG. 6B is an enlarged plan view showing the enlarged plane of the second modification of the inter-axis distance regulation mechanism of FIG. 6A.
Figure 6A:
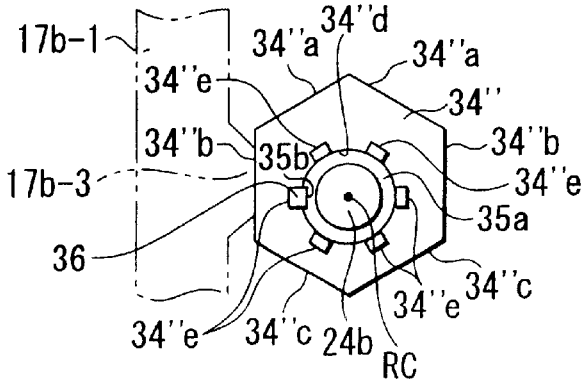
FIG. 6A is an enlarged front view showing the enlarged elevation of a second modification of the inter-axis distance regulation mechanism of the process unit of FIG. 2.

In FIGS. 6A and 6B, an enlarged front view and plan view of the second modification of the rotation type inter-axis distance regulation member 34 of the inter-axis distance regulation mechanism 32 shown in FIG. 2 through FIG. 4B are shown.

A rotation type inter-axis distance regulation member 34" of the second modification holds the bearing 24*c* and is used in combination with a sleeve 35 fixed on each of the two side walls 22*d*-1 of the developing roller frame 24*d*. The sleeve 35 includes a circular supporting member 35*a* projecting outward from the side wall 22*d*-1 and arranged in a concentric manner with respect to the bearing 24*c*. On the outer peripheral surface of the circular supporting member 35*a*, a key groove 35*b* is formed. The key groove 35*b* opens toward the predetermined site 17*b*-3 of the end surface of each of the two side walls 17*b*-1 of the photosensitive drum frame 17*b* and extends along the rotation center line of the bearing 24*c*.

The rotation type inter-axis distance regulation member 34" includes an opening 34"*d* fitted on the circular supporting member 35*a* of the sleeve 35 in a rotatable manner, and multiple pairs of contact surface sites 34"*a*, 34"*b* and 34"*c* whose distances from the rotation center CR of itself in the radial direction with respect to the center of the opening 34"*d* are different from each other. The multiple pairs of contact surface sites 34"*a*, 34"*b* and 34"*c* are crossed each other in the radial direction with respect to the rotation center RC as well as apart from each other in the circumferential direction with respect to the rotation center RC. On the inner peripheral surface of the opening 34"*d*, the key grooves 34"*e* are formed at the multiple positions corresponding to the multiple pairs of the contact surface sites 34"*a*, 34"*b* and 34"*c*, each of the key grooves 34"*e* extends along the rotation center line of the bearing 24*c*.

When the key groove 34"*e* corresponding to the contact surface site 34"*a*, 34"*b* or 34"*c* to be desired to be in contact with the predetermined site 17*b*-3 of each of the end surfaces of the two side walls 17*b*-1 of the photosensitive drum frame 17*b* is arranged to be coincided with the key groove 35*b* on the outer peripheral surface of the circular supporting member 35*a* of the sleeve 35, and a key 36 is forcibly inserted into these key grooves 34"*e*, 35*b*, the rotation type inter-axis distance regulation member 34" can be disposed on the outer peripheral surface of the circular supporting member 35*a* of the sleeve 35 in a state where the desired contact surface site 34"*a*, 34"*b* or 34"*c* is in contact with the predetermined site 17*b*-3 of each of the respective end surfaces of the two side walls 17*b*-1 of the photosensitive drum frame 17*b*.

In the inter-axis distance regulation mechanism 32 shown in FIG. 2 and FIG. 3, even in the case where the rotation type inter-axis distance regulation member 34" shown in FIG. 6A and FIG. 6B is used instead of the rotation type inter-axis distance regulation member 34 shown in FIG. 4A and FIG. 4B, the inter-axis distance regulation mechanism 32 can be functioned similar to the case where the rotation type inter-axis distance regulation member 34 shown in FIG. 4A and FIG. 4B is used.

Specifically, the rotation type inter-axis distance regulation member 34" can be rotated between the rotation positions of the multiple stages by the number of the multiple key grooves 34"*e* by the changing the key groove which corresponds to the key groove 35 of the circular supporting member 35*a* of the sleeve 35 on each of the two side walls 22*d*-1 of the developing roller frame 24*d* among the multiple key grooves 34"*e* of the rotation type inter-axis distance regulation member 34", into which the key 36 is inserted for fixing them. As a result, one of the contact surface sites 34"*a*, 34"*b* or 34"*c* of the rotation type inter-axis distance regulation member 34" on each of the two side walls 22*d*-1 of the developing roller frame 24*d*, which is in contact with the predetermined site 17*b*-3 of each of the respective end surfaces of the two side walls 17*b*-1 of the photosensitive drum frame 17*b*, is changed. This means that the mutual rotation distance between the photosensitive drum frame 17*b* and the developing roller frame 24*d* can be easily changed in multiple stages by the number of the multiple key grooves 34"*e*, and further this means that the mutual distance (space or contact depth) S between the outer peripheral surface OS of the photosensitive drum 17 supported by the photosensitive drum frame 17*b* and the outer peripheral surface OS of the developing roller 24*a* supported by the developing roller frame 24*d* can be easily changed in the multiple stages by the number of the multiple key grooves 34'*e*.

Figure 7:
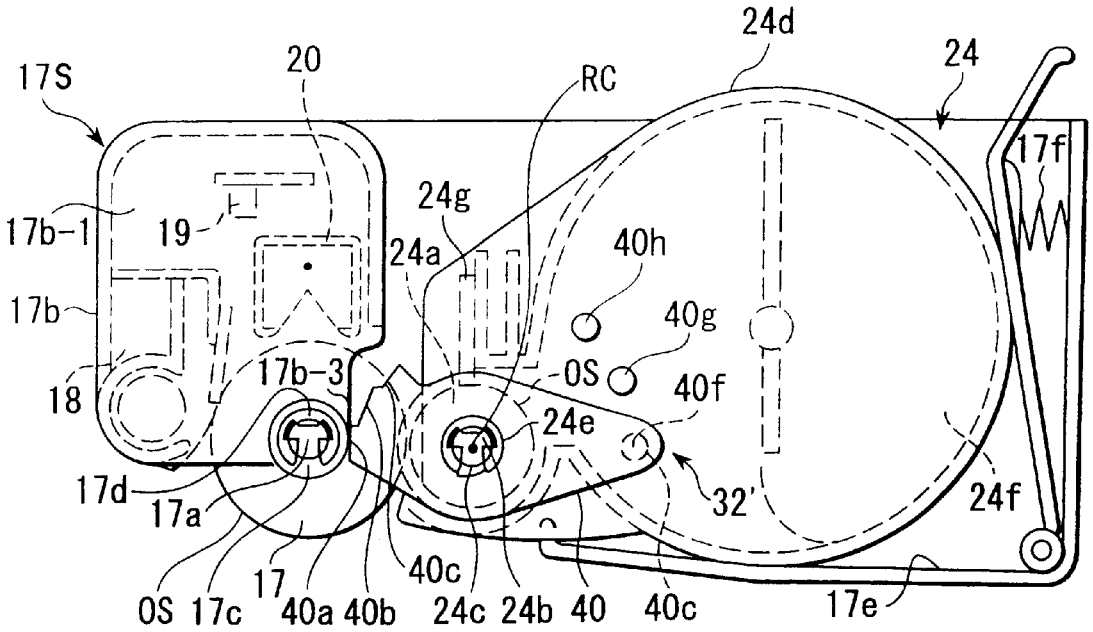
FIG. 7 is a front view showing a process unit according to a second embodiment of the present invention.
Figure 8A:
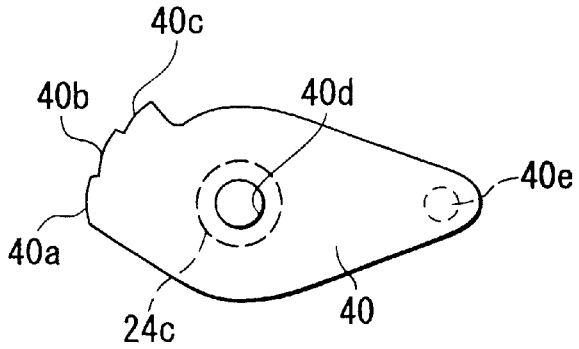
FIG. 8A is an enlarged front view showing the enlarged front of the inter-axis distance regulation mechanism of the process unit of FIG. 7.
Figure 8B:
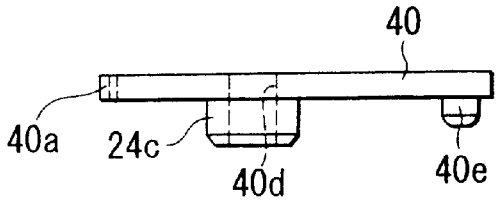
FIG. 8B is an enlarged plan view showing the enlarged plane of the inter-axis distance regulation mechanism of FIG. 8.

Next, referring to FIG. 7, FIG. 8A and FIG. 8B, a process unit according to the second embodiment of the present invention and an inter-axis distance regulation mechanism for use in it will be described in detail below.

A process unit according to the second embodiment can be used instead of the process unit according to the first embodiment of the present invention shown in FIG. 1 through FIG. 4B.

It should be noted that in a variety of members of the process unit according to the second embodiment, the reference characters which are the same as the reference characters used for pointing out the members of the first embodiment are attached to the members of the process unit according to the second embodiment and corresponding to the members of the first embodiment, and the detailed description of the members will be omitted.

Even in the present embodiment, as to the photosensitive drum frame 17*b* of the photosensitive drum section 17S and the developing roller frame 24*d* of the developing device section 24, while the photosensitive drum 17 and the developing roller 24*b* are disposed so that outer peripheral surfaces OS thereof are adjacent to each other, the photosensitive drum frame 17*b* of the photosensitive drum section 175 and the developing roller frame 24*d* of the developing device section 24 are coupled to each other so that the rotation center axis 17*a* of the photosensitive drum 17 and the rotation center axis 24*b* of the developing roller 24*a* are arranged in parallel to each other and are directed in the same direction, and the mutual distance (space or contact depth) S between the outer peripheral surface OS of the photosensitive drum 17 and the outer peripheral surface OS of the developing roller 24*a* is adjustable.

However, in the present embodiment, the photosensitive drum frame 17*b* of the photosensitive drum section 17S and the developing roller frame 24*d* of the developing device section 24 are coupled as described above by the configuration different from the case of the first embodiment.

As described in detail, the photosensitive drum frame 17*b* of the photosensitive drum section 175 is provided with a developing device section holding section 17*e* in which the developing device section 24 is held in a detachable manner. In the developing device section holding section 17*e*, the developing device section 24 is held so that the outer peripheral surface OS of the developing roller 24*a* is located adjacent to the outer peripheral surface OS of the photosensitive drum 17 of the photosensitive drum section 17S. In the developing device section holding section 17*e*, urging means 17*f* for urging the developing device section 24 is disposed so that the outer peripheral surface OS of the developing roller 24*a* is made approach toward the outer peripheral surface OS of the photosensitive drum 17.

In the present embodiment, an inter-axis distance regulation mechanism 32' is provided on either one of the photosensitive frame 17*b* of the photosensitive drum section 17S and the developing roller frame 24*d* of the developing device section 24. The inter-axis distance regulation mechanism 32' is in contact with the predetermined position of the other of the photosensitive drum frame 17*b* and the developing roller frame 24*d*, and can adjust the mutual distance S between the outer peripheral surface OS of the developing roller 24*a* and the outer peripheral surface OS of the light-sensitive body drum 17 in multiple stages. The inter-axis distance regulation mechanism 32' can adjust the distance S by moving itself between in multiple stages.

In more detail, the inter-axis distance regulation mechanism 32' is provided in a rotatable manner by which the inter-axis distance regulation mechanism 32' is rotatable between the rotation positions of the multiple stages in the developing roller frame 24*d*, and is provided with a rotation type inter-axis distance regulation member 40 having a plurality of contact surface sites 40*a*, 40*b* and 40*c* whose distances from the rotation center RC are different from each other in the radial direction with respect to the rotation center RC of themselves.

Concretely, the rotation type inter-axis distance regulation member 40 is combined with one of the bearings 24*c* for rotatably supporting both end portions of the rotation center axis 24*b* of the developing roller 24*a*, and includes the opening 40*d* into which one end portion of the rotation center axis 24*b* inserted Pinto the one of the bearings 24*c* is inserted. Therefore, when the opening 40*d* of the rotation type inter-axis distance regulation member 40 as well as the bearing 24*c* is fitted on one of the both end portions of the rotation center axis 24*b* of the developing roller 24*a*, the rotation type inter-axis distance regulation member 40 can rotate around the center of the opening 40*d* as the rotation center RC, on one of the both end portions of the rotation center axis 24*b* of the developing roller 24*a* on one of the two side walls 24*d*-1 of the developing roller frame 24*d*. The falling of the rotation type inter-axis distance regulation member 40 from one of the both end portions of the rotation center axis 24*b* is prevented by the snap ring 24*e* fixed on each of the outer projecting parts on both end portions of the rotation center axis 24*b* inserted into the opening 40*d* of the rotation type inter-axis distance regulation member 40 in a detachable manner.

A plurality of contact surface sites 40*a*, 40*b* and 40*c* of the rotation type inter-axis distance regulation member 40 are configured of a plurality of concentric partial circles with respect to the rotation center RC as well as these are apart from each other in a circumferential direction with respect to the rotation center of themselves (i.e., center of the opening 40*d*) RC.

On the rotation type inter-axis distance regulation member 40, a positioning pin 40*e* is fixed at a position apart from the contact surface sites 40*a*, 40*b*, and 40*c* in an approximately opposite direction opposing to the sites with respect to the rotation center RC.

On one of the two side walls 24*d*-1 of the developing roller frame 24*d* corresponding to the rotation type inter-axis distance regulation member 40, the positioning concave places 40*f*, 40*g* and 40*h* are formed at three predetermined positions on a circle drawn by the positioning pin 40*e* when the rotation type inter-axis distance regulation member 40 is rotated on the corresponding one of the both end portions of the rotation center axis 24*b* of the developing roller 24*a*. When the positioning pin 40*e* is dropped into any one of multiple positioning concave places 40*f*, 40*g* and 40*h*, any one of the contact surface sites 40*a*, 40*b* and 40*c* corresponding to any one of the multiple positioning concave places 40*f*, 40*g* and 40*h* into which the positioning pin 40*e* is dropped is in contact with the predetermined site 17*b*-3 of the end surface of one of the two side walls 17*b*-1 of the photosensitive drum frame 17*b* corresponding to the rotation type inter-axis distance regulation member 40.

The contact of any one of the contact surface sites 40*a*, 40*b* and 40*c* of the rotation type inter-axis distance regulation member 40 on the one of the two side walls 24*d*-1 of the developing roller frame 24*d* with the predetermined site 17*b*-3 of the one of the two side walls 17*b*-1 of the photosensitive drum frame 17*b* is stably kept by the urging force of the urging means 17*f* for urging the developing device section 24 so that the outer peripheral surface OS of the developing roller 24*a* approaches toward the outer peripheral surface OS of the photosensitive drum 17 in the developing device section holding section 17*e* of the photosensitive drum frame 17*b* without generating a gap.

Specifically, in the rotation type inter-axis distance regulation mechanism 32' configured as described above, the rotation type inter-axis distance regulation member 40 can be rotated between the rotation positions of the multiple stages by the number of the multiple positioning concave places 40*f*, 40*g* and 40*h* by changing the positioning concave place into which the positioning pin 40*e* is dropped among the multiple positioning concave places 40*f*, 40*g* and 40*h* of the rotation type inter-axis distance regulation member 40 on the one of the two side walls 22*d*-1 of the developing roller frame 24*d*. As a result, the one of the contact surface sites 40*a*, 40*b* or 40*b* of the rotation type inter-axis distance regulation member 40 on the one of the two side walls 22*d*-1 of the developing roller frame 24*d*, which is in contact with the predetermined site 17*b*-3 of the one of the end surfaces of the two side walls 17*b*-1 of the photosensitive drum frame 17*b* is changed. This means that the relative position of the developing device section 24 in the developing device section holding section 17*e* of the photosensitive drum frame 17*b* can be easily changed in multiple stages by the number of the multiple positioning concave places 40*f*, 40*g* and 40*h*, and further this means that the mutual distance (space or contact depth) S between the outer peripheral surface OS of the photosensitive drum 17 supported by the photosensitive drum frame 17*b* and the outer peripheral surface OS of the developing roller 24*a* supported by the developing roller frame 24*d* can be easily changed in the multiple stages by the number of the multiple positioning concave places 40*f*, 40*g* and 40*h*.

Figure 9:
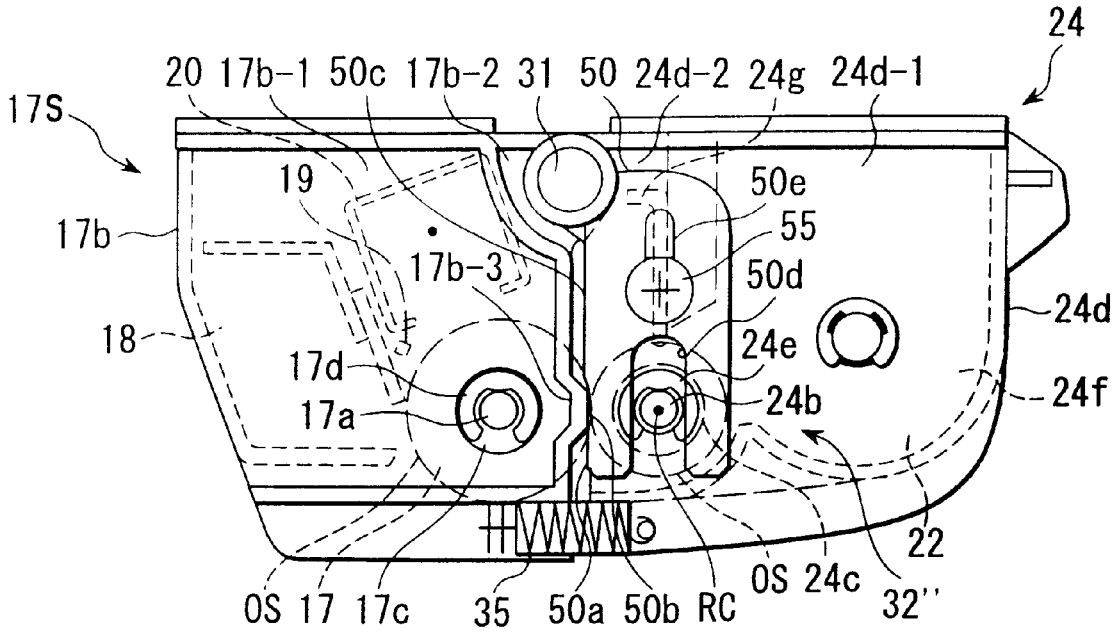
FIG. 9 is a front view schematically showing a process unit according to a third embodiment of the present invention.
Figure 10B:
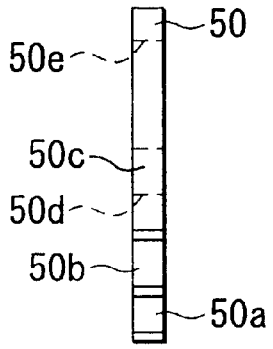
FIG. 10B is an enlarged side view showing the enlarged side elevation of the inter-axis distance regulation mechanism of FIG. 10A.
Figure 10A:
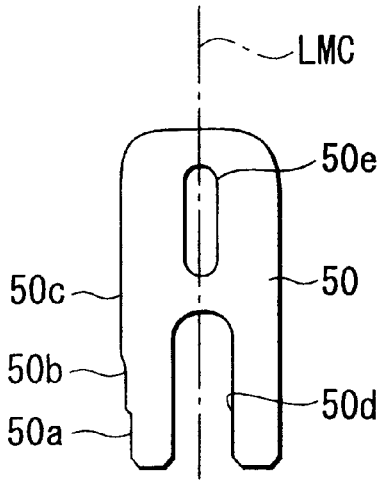
FIG. 10A is an enlarged front view showing the enlarged elevation of an inter-axis distance regulation mechanism of the process unit of FIG. 9.

Next, referring to FIG. 9, FIG. 10A and FIG. 10B, a process unit according to a third embodiment of the present invention and an inter-axis distance regulation mechanism for use in it, will be described in detail below.

A process unit according to the third embodiment can be used in the image formation device 10 of FIG. 1, instead of the process unit according to the first embodiment of the present invention shown in FIG. 1 through FIG. 4B.

It should be noted that in a variety of the constituting members of the process unit according to the third embodiment, the reference characters which are the same as the reference characters used for pointing out the members of the first embodiment are attached to the members of the process unit according to the third embodiment and corresponding to the members of the first embodiment, and the detailed description of the members will be omitted.

Also in the present embodiment, the photosensitive drum frame 17*b* of the photosensitive drum section 17S and the developing roller frame 24*d* of the developing device section 24 are coupled each other through the coupling axis 31, while the photosensitive drum 17 and the developing roller 24*a* are disposed so that the outer peripheral surfaces OS thereof are adjacent to each other, the rotation center axis 17*a* of the photosensitive drum 17 and the rotation center axis 24*b* of the developing roller 24*a* are arranged in parallel to each other and are directed in the same direction, and the mutual distance (space or contact depth) S between the outer peripheral surface OS of the photosensitive drum 17 and the outer peripheral surface OS of the developing roller 24*a* is adjustable.

Next, the inter-axis distance regulation mechanism 32" of the present embodiment will be described in detail below.

The inter-axis distance regulation mechanism 32" has a linearly moving type inter-axis distance regulation member 50 which is provided in a linearly movable manner by which the linearly moving type inter-axis distance regulation member 50 can be movable between linearly moving positions of the multiple stages on either of the photosensitive drum frame 17*b* and the developing roller frame 24*d*. The linearly moving type inter-axis distance regulation member 50 has a plurality of contact surface sites 50*a*, 50*b* and 50*c* which are disposed apart from each other in the linearly moving direction thereof, and whose distances from the linearly moving center LMC of the member 50 are different from each other in the direction crossing with the linearly moving direction.

In more detail, the linearly moving type inter-axis distance regulation member 50 includes first and second moving guide holes 50*d* and 50*e* extending in the linearly moving direction at positions apart from each other along the linear moving direction. Into the first moving guide hole 50*d*, the portion, projecting outwardly from the bearing 24, of the both end portions of the rotation center axis 24*b* of the developing roller 24*a* is inserted and of the outer peripheral surface of the outwardly projecting portion is in contact in a slidable manner with a pair of moving guide edges of the first moving guide hole 50*d* extending in parallel to each other in the linearly moving direction of the first moving guide hole 50*d*. The moving guide screw 50*f* is inserted into the second moving guide hole 50*e*, the outer peripheral surface of the inserted moving guide screw 50*f* is in contact in a slidable manner with a pair of moving guide edges of the second moving guide hole 50*e* extending in parallel to each other in the linearly moving direction of the second moving guide hole 50*e*, the inserted moving guide screw 50*f* is screwed in a detachable manner at the predetermined position on each of the two side walls 24*d*-1 of the developing roller frame 24*d*.

The linearly moving type inter-axis distance regulation member 50 is movable in the linear moving direction on each of the two side walls 24*d*-1 of the developing roller frame 24*d* by loosening the engagement of the moving guide screw 50*f* and the linearly moving type inter-axis distance regulation members 50 is fixed at a position along the linearly moving direction on each of the two side walls 24*d*-1 of the developing roller frame 24*d* by tightening the engagement of the moving guide screw 50*f*.

When the linearly moving type inter-axis distance regulation member 50 is fixed at any one of the multiple predetermined linearly moving positions along the linearly moving direction, any one of the contact surface sites 50*a*, 50*b* and 50*c* is in contact with the predetermined site 17*b*-3 of the end surface of each of the two side walls 17*b*-1 of the photosensitive drum frame 17*b*.

The above-described contact being stably maintained without generating a gap is secured by the tension coil spring 35 spanning between the lower end portion of each of the two side walls 17*b*-1 of the photosensitive drum frame 17*b* and the lower end portion of each of the two side walls 24*d*-1 of the developing roller frame 24*d*. The spring 35 urges the two side walls 17*b*-1 of the photosensitive drum frame 17*b* and the two side walls 24*d*-1 of the developing roller frame 24*d* to each other.

Specifically, in the inter-axis distance regulation mechanism 32" configured as described above, one of the contact surface sites out of the multiple contact surface sites 50*a*, 50*b* and 50*c* of the linearly moving type inter-axis distance regulation member 50 on each of the two side walls 24*d*-1 of the developing roller frame 24*d*, which is in contact with the predetermined site 17*b*-3 of each of the end surfaces of the two side walls 17*b*-1 of the photosensitive drum frame 17*b* is changed by changing the predetermined linearly moving position out of the multiple linear moving positions at which the linearly moving type inter-axis distance regulation member 50 is fixed on each of the respective two side walls 24*d*-1 of the developing roller frame 24*d*. This means that the mutual rotation distance between the photosensitive frame 17*b* centering the coupling axis 31 as the center and the developing roller frame 24*d* can be easily changed in the multiple stages by the number of the multiple positioning holes 34*e*, 34*f* and 34*g*. Further, this means that the mutual distance (space or contact depth) S between the outer peripheral surface OS of the photosensitive drum 17 supported by the photosensitive drum frame 17*b* and the outer peripheral surface OS of the developing roller 24*a* supported by the developing roller frame 24*d* can be easily changed in the multiple stages by the number of the multiple positioning holes 34*e*, 34*f* and 34*g*.

Next, a color image formation device 60 provided with a process unit according to a fourth embodiment of the present invention will be described below with reference to FIG. 11.

It should be noted that the essential configuration of the color image formation device 60 is the same as the essential configuration of the image formation device 10 provided with the process unit according to the first embodiment of the present invention with reference to FIG. 1. Therefore, in the color image formation device 60, the reference characters which are the same as the reference characters used for pointing out the members of the image formation device 10 of FIG. 1 are attached to the members of the image formation device 60 of FIG. 11 corresponding to the members of the first embodiment, and the detailed description of the members will be omitted.

In the lower portion in an outer housing 60*a* of the color image formation device 60, two paper supplying cassettes 12 arranged in up- and down-direction are disposed in a detachable manner. In the paper supplying cassette 12, multiple sheets of the recording paper P in the predetermined size and shape, are stored in a stacked manner.

In the outer housing 60*a*, from the one end portion of the paper cassette 12, a paper conveyance path 14*a* extends along the one of the side walls of the outer housing 60*a* toward the upper portion of the outer housing 60*a*. The paper conveyance path 14*a* further extends in an approximately horizontal direction so as to direct toward the other side wall of the outer housing 10*a* above the paper cassettes 12 at the intermediate portion in the vertical direction in the outer housing 10*a*, and a sub-branch path 14*a*-1 directing in the horizontal direction and a main-branch path 14*a*-2 directing in the upward are branched in the vicinity of the other side wall.

The extending end of the sub-branch path 14*a*-1 reaches an opening 60*d* formed on the upper wall of the armored housing 60*a*. On the outer surface of the other Aside wall, a substitute paper discharging tray 60*c* is disposed just below the opening 60*b*.

The upper end of the main-branch path 14*a*-2 reaches at an opening 60*b* formed on the other side wall of the outer housing 60*a*. On the upper surface of the upper wall, a main paper discharging tray 60*e* is disposed in the portion adjacent to the opening 60*d*.

From each of the two paper supplying cassettes 12, a sheet of the recording paper P of the desired size and shape can be sent out one by one toward a pair of recording paper supplying rollers 14*c* of the entrance of the paper conveyance path 14*a* corresponding to each of the paper supplying cassettes 12 by a pickup roller 14*b* corresponding to the respective paper supplying cassette 12.

Figure 11:
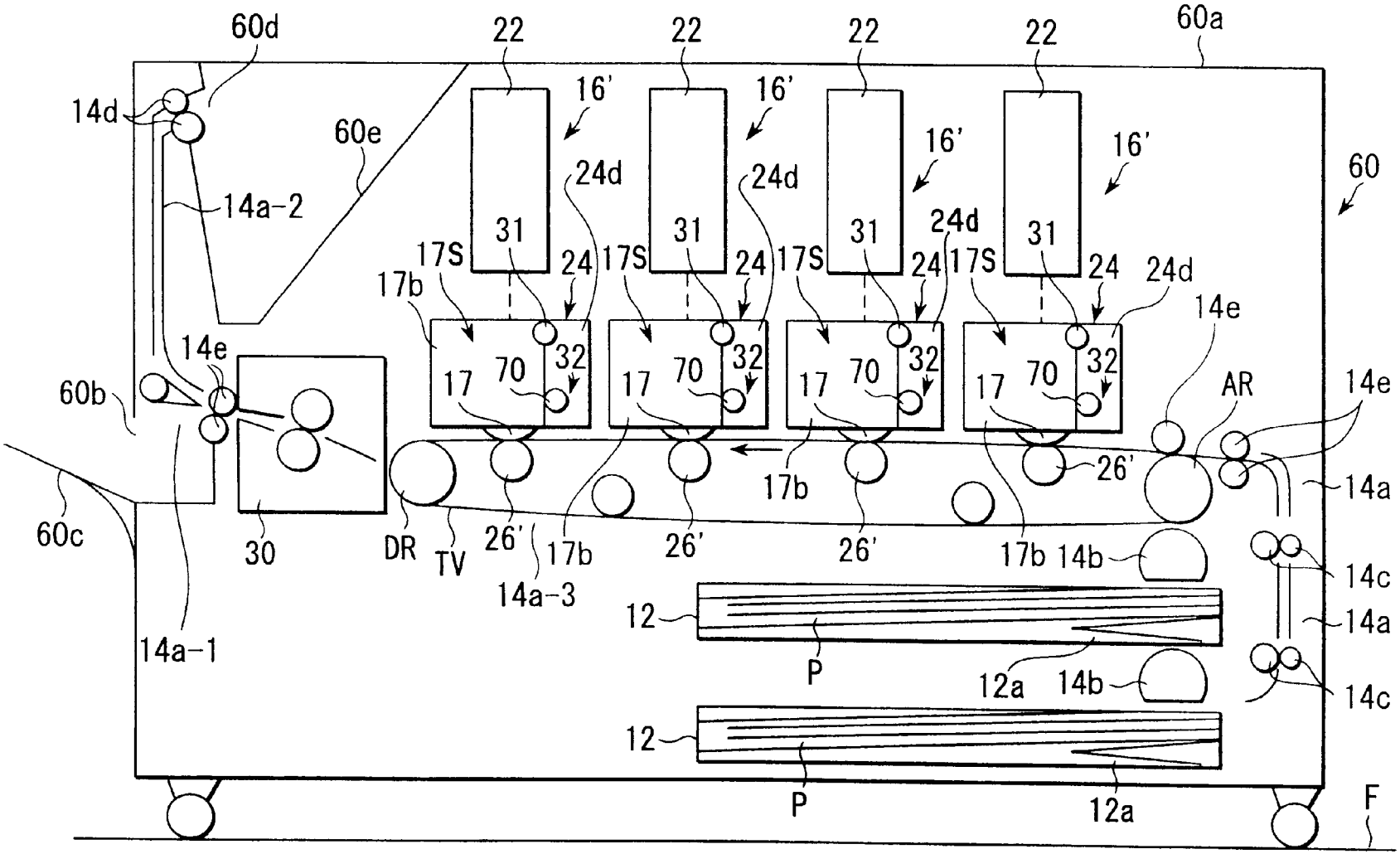
FIG. 11 is a vertical sectional view schematically showing a color image formation device provided with a process unit according to a fourth embodiment of the present invention.

A plurality of the recording paper conveying rollers 14*e* disposed along the paper conveyance path 14*a* are also shown in FIG. 11.

The horizontally extending portion of the paper conveyance path 14*a* is configured by a conveying belt device 14*a*-3, the carrying belt device 14*a*-3 includes a drive roller DR, a driven roller AR disposed at positions apart from each other at the predetermined distance in the horizontal direction, and a conveying belt TV spanning on the drive roller DR and the driven roller AR.

Four process units 16' for forming toner images of four colors (cyan, magenta, yellow and black) are aligned along the upper extending portion of the conveying belt TV of the conveying belt device 14*a*-3. The four process units 16' have the same configurations with each other, the difference is only thing that the colors of the toner used therein are different from each other. The configurations of the four process units 16' are almost the same as the configuration of the process unit 16 of the image formation device 10 of FIG. 1, however, a transfer roller 26' is used as a transfer device, and the separating device is not used.

The difference between the configuration of each of the four process units 16' and the configuration of the process unit 16 of the image formation device 10 of FIG. 1 is further in the configuration of the inter-axis distance regulation member 70 of the inter-axis distance regulation mechanism 32.

Four process unites 16' used in this color image formation device 60 have the same configuration as to each other, but a mutual distance (gap or contact depth) between the outer peripheral surface OS of the photosensitive drum 17 and the outer peripheral surface OS of the developing roller 24*a* in each unit 16' shown in FIG. 3 must be determined at its prefer value in accordance with a kind (color) of toner used therein.

The inter-axis distance regulation member 70 of the inter-axis distance regulation mechanism 32 of each unit 16' has four contact surfaces. More specifically, The inter-axis distance regulation member 70 has almost the same configuration as that of the inter-axis distance regulation member 34 of the inter-axis distance regulation mechanism 32 of the process unit 16 of the image formation apparatus 10 shown in FIG. 1, and a further one contact surface 70*a* in addition to the three contact sites 34*a*, 34*b*, and 34*c* those of which are formed on the inter-axis distance regulation member 34.

A distance of the additional one contact site 70*a* from the rotation center RC of the inter-axis distance regulation member 70 in its radial direction is different from each of those of the three contact sites 34*a*, 34*b*, and 34*c*. These four contact sites 34*a*, 34*b*, 34*c*, and 70*a* are away from each other in the circumferential direction with respect to its rotation center (that is, a center of the opening 34*d*) and are configured by a plurality of circles centers of which are coincide with each other.

The inter-axis distance regulation member 70 further has one positioning hole 70*b* in addition to the three positioning holes 34*e*, 34*f*, and 34*g* those of which are formed on the inter-axis distance regulation member 34, and the positioning hole 70*b* is arranged on a straight line connecting the additional one contact surface 70*a* and the rotation center RC in an opposite side of the rotation center RC opposition the additional one contact surface 70*a*. These four contact sites 34*a*, 34*b*, 34*c*, and 70*b* are arranged on a circle the center of which is the rotation center RC of the inter-axis distance regulation member 70.

When the positioning pin 34*h* (referring to FIGS. 2 and 4B) is inserted into any one of the positioning holes 34*e*, 34*f*, 34*g* and 70*b* and the positioning pin 34*h* is fixed on the side surface 24*d*-1 of the developing roller frame 24*d* corresponding to the positioning pin 34*h*, any one of the four contact sites 34*a*, 34*b*, 34*c*, and 70*a* corresponding to any one of the positioning holes 34*e*, 34*f*, 34*g* and 70*b* with both of which being arranged on the same straight line connecting therewith is in contact with the predetermined position 17*b*-3 on each of the end faces of the two side walls 17*b*-1 adjacent to the two side walls 24*d*-1 of the developing roller frame 24*d*, like in the inter-axis distance regulation member 34 of the first embodiment shown in FIGS. 2 and 4B.

That is, in the inter-axis distance regulation member 32 as configured as described above, by changing a positioning hole into which the positioning pin 34*h* (referring to FIGS. 2 and 4B) is inserted for fixation among the four positioning holes 34*e*, 34*f*, 34*g* and 70*b* of the inter-axis distance regulation member 70 on each of the two side walls 24*d*-1 (referring to FIGS. 2 and 4B) of the developing roller frame 24*d*, the inter-axis distance regulation member 70 can be rotated between four rotation positions the number of which is the same as that of the four positioning holes 34*e*, 34*f*, 34*g* and 70*b*. As a result of this, a contact site which is in contact with the predetermined portion 17*b*-3 of each of the two side walls 17*b*-1 of the photosensitive drum frame 17*b* is changed among the four contact sites 34*a*, 34*b*, 34*c*, and 70*a* c of the inter-axis distance regulation member 70 on each of the two side walls 24*d*-1 of the developing roller frame 24*d*. This means that a rotation distance of one the photosensitive drum frame 17*b* and the developing roller frame 24*d* relative to the other around the connection axis 31 can be easily changed at four stages. Further, it means that the mutual distance (gap or contact depth)between the outer peripheral surface OS of the photosensitive drum 17 supported by the photosensitive drum frame 17*b* and the outer peripheral surface OS of the developing roller 24*a* supported by the developing roller frame 24*d* can be changed easily at four stages.

Figure 13B:
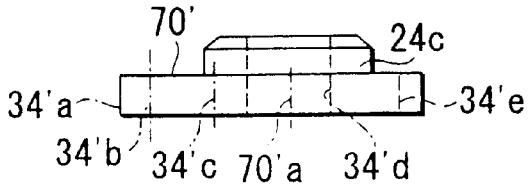
FIG. 13B is an enlarged plan view showing the enlarged plane of a modification of the inter-axis distance regulation mechanism of FIG. 13A.
Figure 13A:
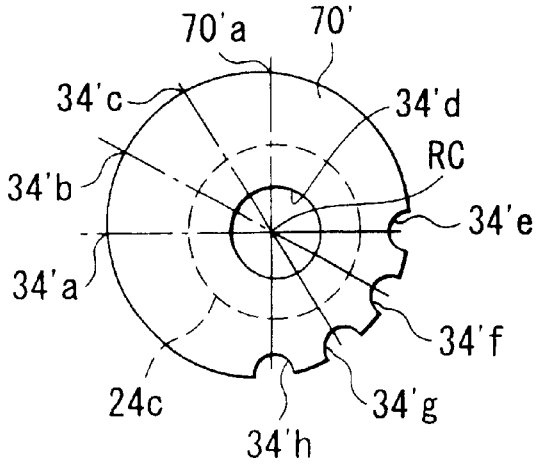
FIG. 13A is an enlarged front view showing the elevation of a modification of an inter-axis distance regulation mechanism of the process unit of FIG. 11.

In FIGS. 13A and 13B, a front view and plan view of a modification of the inter-axis distance regulation member 70 of the inter-axis distance regulation mechanism 32 of each of the four process units 16' used in the color image formation apparatus 60 shown in FIG. 11.

An inter-axis distance regulation member 70' of the modification has almost the same configuration as that of the inter-axis distance regulation member 34' of the first modification shown in FIGS. 5A and 5B and used for the inter-axis distance regulation mechanism 32 of the process unit 16 of the image formation 10 shown in FIG. 1. The inter-axis distance regulation member 70' has one contact site 70'*a* in addition to the three contact sites 34'*a*, 34'*b*, and 34'*c* being formed on the inter-axis distance regulation member 34'.

A distance of the additional one contact site 70'*a* from the rotation center RC of the inter-axis distance regulation member 70' in its radial direction is different from each of those of the three contact sites 34'*a*, 34'*b*, and 34'*c*. These four contact sites 34'*a*, 34'*b*, 34'*c*, and 70'*a* are away from each other in the circumferential direction with respect to its rotation center (that is, a center of the opening 34*d*) and are configured by one eccentric circle whose center is displaced from the rotation center RC.

The inter-axis distance regulation member 70' further has one positioning concave place 70'*b* in addition to the three positioning concave places 34'*e*, 34'*f*, and 34'*g* those of which are formed on the inter-axis distance regulation member 34', and the positioning concave place 70'*b* is arranged on a straight line connecting the additional one contact surface 70'*a* and the rotation center RC in an opposite side of the rotation center RC opposition the additional one contact surface 70'*a*. These four contact sites 34'*a*, 34'*b*, 34'*c*, and 70'*b* are arranged on a circle the center of which is the rotation center RC of the inter-axis distance regulation member 70'.

Figure 12B:
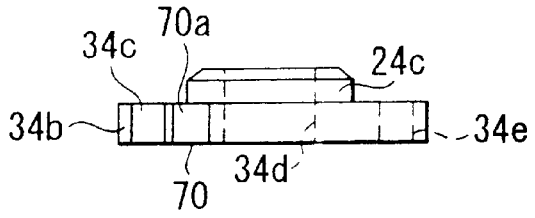
FIG. 12B is an enlarged plan view showing the enlarged plane of the inter-axis distance regulation mechanism of FIG. 12A.
Figure 12A:
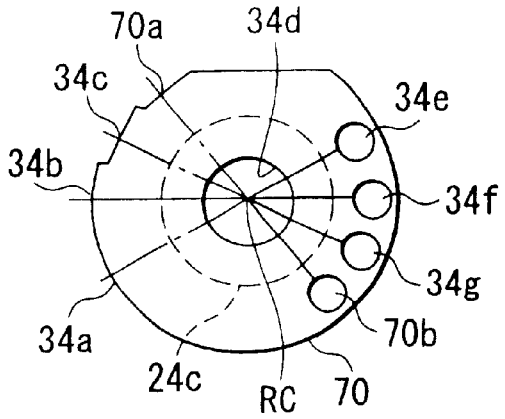
FIG. 12A is an enlarged front view showing the elevation of the inter-axis distance regulation mechanism of the process unit of FIG. 11.

When the inter-axis distance regulation member 70' shown in FIGS. 13A and 13B is used, instead of the inter-axis distance regulation member 70 shown in FIGS. 12A and 12B, in the inter-axis distance regulation mechanism 32 of each of the four process units 16' used in the color image formation apparatus 60 shown in FIG. 11. the inter-axis distance regulation mechanism 32 can act as it use the inter-axis distance regulation member 70 shown in FIGS. 12A and 12B.

That is, by changing a positioning concave place into which the positioning pin 34*h* (referring to FIGS. 2 and 4B) is inserted for fixation among the four positioning concave places 34'*e*, 34'*f*, 3'4*g* and 70'*b* of the inter-axis distance regulation member 70' on each of the two side walls 24*d*-1 (referring to FIGS. 2 and 4B) of the developing roller frame 24*d*, the inter-axis distance regulation member 70' can be rotated between four rotation positions the number of which is the same as that of the four positioning concave places 34'*e*, 34'*f*, 34'*g* an 70'*b*. As a result of this, a contact site which is in contact with the predetermined portion 17*b*-3 of each of the two side walls 17*b*-1 of the photosensitive drum frame 17*b* is changed among the four contact sites 3'*a*, 34'*b*, 34'*c*, and 70'*c* of the inter-axis distance regulation member 70' on each of the two side walls 24*d*-1 of the developing roller frame 24*d*. This means that a rotation distance of one of the photosensitive drum frame 17*b* and the developing roller frame 24*d* relative to the other around the connection axis 31 can be easily changed at four stages. Further, it means that the mutual distance (gap or contact depth) between the outer peripheral surface OS of the photosensitive drum 17 supported by the photosensitive drum frame 17*b* and the outer peripheral surface OS of the developing roller 24*a* supported by the developing roller frame 24*d* can be changed easily at four stages.

As apparent from the above description, according to the present invention, the number of the contact sites in each of the rotational type and linear movement type inter-axis distance regulation members 34, 34', 34", 40, 50, 70, and 70' of the various embodiments and various modifications described above can be set at any value. Further, the rotational type an linear movement type inter-axis distance regulation members 34, 34', 34", 40, 50, 70, and 70', provided that the following predetermined items are satisfied, can be used in any number on the rotation center axis 24*b* of the developing roller 24, on the rotation center axis 17*a* of the photosensitive drum 17, or on any desirable position or positions, excepting the rotation center axis 24*b* of the developing roller 24 and the rotation center axis 17*a* of the photosensitive drum 17, on either one of the developing roller frame 24*d* or the photosensitive drum frame 17*b*. In this case, a portion with which any one of the contact sites of act of the rotational type and linear movement type inter-axis distance regulation members 34, 34', 34", 40, 50, 70, and 70' is in contact must be provided at any position on the other of the developing roller frame 24*d* and the photosensitive drum frame 17*b*.

The predetermined items are such that a stiffness of each of the developing roller frame 24*d* and the photosensitive drum frame 17*b* is high, and, even if any number of the rotational type and linear movement type inter-axis distance regulation members 34, 34', 34", 40, 50, 70, and 70' is or are used, the rotation center axis 17*a* of the photosensitive drum 17 and the rotation center axis 24*b* of the developing roller frame 24 can maintain their parallel arrangement and their extending directions while the developing roller frame 24*d* and the photosensitive drum frame 17*b* are moved relative to each other.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A process unit comprising:

a photosensitive drum section which includes a photosensitive drum having a rotation center axis and an outer peripheral surface, and a photosensitive drum frame supporting the rotation center axis of the photosensitive drum in a rotatable manner;

a developing device section which includes a developing roller having a rotation center axis and an outer peripheral surface, and a developing roller frame supporting the rotation center axis of the developing roller in a rotatable manner, said roller frame and said drum frame being coupled so that a mutual distance between the outer peripheral surface of the developing roller and the outer peripheral surface of the photosensitive drum is set in an adjustable manner and so that the rotation center axis of the developing roller is parallel to the rotation center axis of the photosensitive drum and is directed in a same direction with respect to the rotation center axis of the photosensitive drum in a state where the developing roller is located adjacent to the photosensitive drum; and an inter-axis distance regulation mechanism which is provided on one of the drum frame and the roller frame in a movable manner in multiple stages, and which is in contact with the other of the drum frame and the roller frame, said inter-axis distance regulation mechanism adjusting the mutual distance between the outer peripheral surface of the developing roller and the outer peripheral surface of the photosensitive drum in multiple stages by movement of the regulation mechanism in the multiple stages relative to the one of the drum frame and the roller frame on which the regulation mechanism is provided.

2. The process unit according to claim 1, wherein the inter-axis distance regulation mechanism comprises a rotation type inter-axis distance regulation member which is provided on one of the drum frame a d the roller frame so that the regulation member is rotatable in multiple stages, said regulation member having a plurality of contact surface sites whose distances from a rotation center of the regulation member are different in a radial direction with respect to the rotation center, and any one of the multiple contact surface sites being in contact with a predetermined position of the other one of the drum frame and the roller frame at each of the multiple stages to thereby adjust the mutual distance between the outer peripheral surface of the developing roller and he outer peripheral surface of the photosensitive drum in the multiple stages.

3. The process unit according to claim 2, wherein the plurality of contact surface sites of the regulation member are configured by a plurality of flat planes which are apart from each other in a circumferential direction with respect to the rotation center of the regulation member and which cross each other in a radial direction with respect to the rotation center of the regulation member.

4. The process unit according to claim 2, wherein the plurality of contact surface sites of the regulation member are configured by a plurality of parts of concentric circles with respect to the rotation center of the regulation member, and each of the parts is apart from each other in a circumferential direction with respect o the rotation center of the regulation member.

5. The process unit according to claim 2, wherein the plurality of contact surface sites of the regulation member are configured by one eccentric circle with respect to the rotation center of the regulation member.

6. The process unit according to claim 2, wherein the regulation member is provided on one of the rotation center axis of the photosensitve drum of the drum frame and the rotation center axis of the developing roller of the roller frame and is rotatable in the multiple stages.

7. The process unit according to claim 6, wherein the process unit further comprises a bearing which supports one of the rotation center axis of the photosensitive drum of the drum frame and the rotation center axis of the developing roller of the roller frame in freely rotatable manner, and the regulation member is combined with the bearing.

8. The process unit according to claim 2, wherein the drum frame and the roller frame are rotatably connected to each other so that the drum frame and the roller frame are rotated relative to each other by gravity to thereby cause the photosensitive drum and the developing roller to approach each other.

9. The process unit according to claim 2, wherein the drum frame and the roller frame are rotatably connected to each other and the process unit further comprises an urging unit which urges the drum frame and the roller frame to be rotated relative to each other to thereby cause the photosensitive drum and the developing roller to approach each other.

10. The process unit according to claim 2, wherein the drum frame and the roller frame are movable relative to each other and the process unit further comprises an urging unit which urges one of the drum frame and the roller frame to be moved relative to the other one of the drum frame and the roller frame to thereby cause the photosensitive drum and the developing roller to approach each other.

11. The process unit according to claim 1, wherein the inter-axis distance regulation mechanism comprises a linearly moving type inter-axis distance regulation member which is provided on one of the drum frame and the roller frame so that the regulation member is linearly movable in the multiple stages, said regulation member having a plurality of contact surface sites disposed along a linear moving direction of the regulation member so that distances of the contact surface sites from a center of the regulation member in the linear moving direction are different, and any one of the contact surface sites being in contact with a predetermined position of the other one of the drum frame and the roller frame at each of the multiple stages to thereby adjust the mutual distance between the outer peripheral surface of the developing roller and the outer peripheral surface of the photosensitive drum in the multiple stages.

12. The process unit according to claim 11, wherein the drum frame and the roller frame are rotatably connected to each other so that the drum frame and the roller frame are rotated relative to each other by gravity to thereby cause the photosensitive drum and the developing roller to approach each other.

13. The process unit according to claim 11, wherein the drum frame and the roller frame are rotatably connected to each other and the process unit further comprises an urging unit which urges the drum frame and the roller frame to be rotated relative to each other to thereby cause the photosensitive drum and the developing roller to approach each other.

14. An image forming device comprising:

a conveyor which conveys a recording paper;

a photosensitive drum section which includes a photosensitive drum having a rotation center axis and an outer peripheral surface, and a photosensitive drum frame supporting the rotation center axis of the photosensitive drum in a rotatable manner;

a charger which charges the outer peripheral surface of the photosensitive drum;

an exposure device which forms a desired electrostatic latent image on the charged outer peripheral surface of the photosensitive drum;

a developing device section which includes a developing roller having a rotation center axis and an outer peripheral surface, and a developing roller frame that supports the rotation center axis of the developing roller in a rotatable manner, said developing roller applying toner to the electrostatic latent image on the outer peripheral surface of the photosensitive drum to form a toner image from the electrostatic latent image, and said roller frame and said drum frame being coupled so that a mutual distance between the outer peripheral surface of the developing roller and the outer peripheral surface of the photosensitive drum is set in an adjustable manner and so that the rotation center axis of the developing roller is parallel to the rotation center axis of the photosensitive drum and is directed in a same direction with respect to the rotation center axis of the photosensitive drum in a state where the developing roller is located adjacent to the photosensitive drum;

an inter-axis distance regulation mechanism which is provided on one of the drum frame and the roller frame in a movable manner in multiple stages, and which is in contact with the other of the drum frame and the roller frame, said inter-axis distance regulation mechanism adjusting the mutual distance between the outer peripheral surface of the developing roller and the outer peripheral surface of the photosensitive drum in multiple stages by movement of the regulation mechanism in the multiple stages relative to the one of the drum frame and the roller frame on which the regulation mechanism is provided;

a transfer device which transfers the toner image formed on the outer peripheral surface of the photosensitive drum to the recording paper conveyed by the conveyor; and a cleaner which removes toner remaining on the outer peripheral surface of the photosensitive drum after the toner image is transferred from the outer peripheral surface of the photosensitive drum to the recording paper.

15. The image forming device according to claim 14, wherein the inter-axis distance regulation mechanism comprises a rotation type inter-axis distance regulation member which is provided on one of the drum frame and the roller frame so that regulation member is rotatable in multiple stages, said regulation member having a plurality of contact surface sites whose distances from rotation center of the regulation member are different in a radial direction with respect to the rotation center, and any one of the multiple contact surface sites being in contact with a predetermined position of the other one of the drum frame and the roller frame at each of the multiple stages to thereby adjust the mutual distance between the outer peripheral surface of the developing roller and the outer peripheral surface of the photosensitive drum in the multiple stages.

16. The image forming device according to claim 15, wherein the plurality of contact surface sites of the regulation member are configured by a plurality of flat planes which are apart from each other in a circumferential direction with respect to the rotation center of the regulation member and which cross each other in a radial direction with respect to the rotation center of the regulation member.

17. The image forming device according to claim 15, wherein the plurality of contact surface sites of the regulation member are configured by a plurality of parts of concentric circles with respect to the rotation center of the regulation member, and the parts are apart from each other in a circumferential direction with respect to the rotation center of the regulation member.

18. The image forming device according to claim 15, wherein the plurality of contact surface sites of the regulation member are configured by one eccentric circle with respect to the rotation center of the regulation member.

19. The image forming device according to claim 15, wherein the regulation member is provided on one of the rotation center axis of the photosensitive drum of the drum frame and the rotation center axis of the developing roller of the roller frame and is rotatable in the multiple stages.

20. The image forming device according to claim 19, wherein the image forming device further comprises a bearing which supports one of the rotation center axis of the photosensitive drum of the drum frame and the rotation center axis of the developing roller of the roller frame in a freely rotatable manner, and the regulation member is combined with the bearing.

21. The image forming device according to claim 15, wherein the drum frame and the roller frame are rotatably connected to each other so that the drum frame and the roller frame are rotated relative to each other by gravity to thereby cause the photosensitive drum and the developing roller to approach each other.

22. The image forming device according to claim 15, wherein the drum frame and the roller frame are rotatably connected to each other and the image forming device further comprises an urging unit which urges the drum frame and the roller frame to be rotated relative to each other to thereby cause the photosensitive drum and the developing roller to approach each other.

23. The image forming device according to claim 15, wherein the drum frame and the roller frame are movable relative to each other and the image forming device further comprises an urging unit which urges one of the drum frame and the roller frame to be moved relative to the other one of the drum frame and the roller frame to thereby cause the photosensitive drum and the developing roller to approach each other.

24. The image forming device according to claim 14, wherein the inter-axis distance regulation mechanism comprises a linearly moving type inter-axis distance regulation member which is provided on one of the drum frame and the roller frame so that the regulation member is linearly movable in the multiple stages, said regulation member having a plurality of contact surface sites disposed along a linear moving direction of the regulation member so that distances of the contact surface sites from a center of the regulation member in the linear moving direction are different, and any one of the contact surface sites being in contact with a predetermined position of the other one of the drum frame and the roller frame at each of the multiple stages to thereby adjust the mutual distance between the outer peripheral surface of the developing roller and the outer peripheral surface the photosensitive body drum in the multiple stages.

25. The image forming device according to claim 24, wherein the drum frame and the roller frame are rotatably connected to each other so that the drum frame and the roller frame are rotated relative to each other by gravity to thereby cause the photosensitive drum and the developing roller to approach each other.

26. The mage forming device according to claim 24, wherein the drum frame and the roller frame are rotatably connected to each other and the image forming device further comprises an urging unit which urges the drum frame and the roller frame to be rotated relative to each other to thereby cause the photosensitive drum and the developing roller to approach each other.

27. A color image forming device comprising:

a conveyor which conveys a recording paper; and a plurality of image forming units which are disposed along a conveyance path of the recording paper conveyed by the conveyor, and which form respective desired color images on the recording paper, wherein each of the plurality of image forming units comprises:

a photosensitive drum section which includes a photosensitive drum having a rotation center axis and an outer peripheral surface, and photosensitive drum frame supporting the rotation center axis of the photosensitive drum in a rotatable manner;

a charger which charges the outer peripheral surface of the photosensitive drum;

an exposure device which forms a desired electrostatic latent image on the charged outer peripheral surface of the photosensitive drum;

a developing device section which includes a developing roller having a rotation center axis and an outer peripheral surface, and a developing roller frame that supports the rotation center axis of the developing roller in a rotatable manner, said developing roller applying toner to the electrostatic latent image on the outer peripheral surface of the photosensitive drum to form one of the respective desired color toner images from the electrostatic latent image, and said roller frame and said drum frame being coupled so that a mutual distance between the outer peripheral surface of the developing roller and the outer peripheral surface of the photosensitive drum is set in an adjustable manner and so that the rotation center axis of the developing roller is parallel to the rotation center axis of the photosensitive drum and is directed in a same direction with respect to the rotation center axis of the photosensitive drum in a state where the developing roller is located adjacent to the photosensitive drum;

an inter-axis distance regulation mechanism which is provided on one of the drum frame and the roller frame in a movable manner in multiple stages, and which is in contact with the other of the drum frame and the roller frame, said inter-axis distance regulation mechanism adjusting the mutual distance between the outer peripheral surface of the developing roller and the outer peripheral surface of the photosensitive drum in multiple stages by movement of the regulation mechanism in the multiple stages relative to the one of the drum frame and the roller frame on which the regulation mechanism is provided;

a transfer device which transfers the desired color toner image formed on the outer peripheral surface of the photosensitive drum to the recording paper being conveyed by the conveyor; and a cleaner which removes toner remaining on the outer peripheral surface of the photosensitive drum after the desired color toner image is transferred from the outer peripheral surface of the photosensitive drum to the recording paper.

28. The color image forming device according to claim 27, wherein the inter-axis distance regulation mechanism comprises a rotation type inter-axis distance regulation member which is provided on one of the drum frame and the roller frame so that the regulation member is rotatable in multiple stages, said regulation member having a plurality of contact surface sites whose distances from a rotation center of the regulation member are different in radial direction with respect to the rotation center, and any one of the multiple contact surface sites being in contact with a predetermined position of the other one of the drum frame and the roller frame at each of the multiple stages to thereby adjust the mutual distance between the outer peripheral surface of the developing roller and the outer peripheral surface of the photosensitive drum in the multiple stages.

29. The color image forming device according to claim 28, wherein the regulation member is provided on one of the rotation center axis of he photosensitive drum of the drum frame and the rotation center axis of the developing roller of the roller frame and is rotatable in the multiple stages.

30. The color image forming device according to claim 26, wherein the drum frame and the roller frame are rotatably connected to each other so that the drum frame and the roller frame are rotated relative to each other by gravity to thereby cause the photosensitive drum and the developing roller to approach each other.

31. The color image forming device according to claim 28, wherein the drum frame and the roller frame are rotatably connected to each other and each image forming unit further comprises an urging unit which urges the drum frame and the roller frame to be rotated relative to each other to thereby cause the photosensitive drum and the developing roller to approach each other.

32. The color image forming device according to claim 28, wherein the d urn frame and the roller frame are movable relative to each other and each image forming unit further comprises an urging unit which urges one of the drum frame and the roller frame to be moved relative to the other one of the drum frame and the roller frame to thereby cause the photosensitive drum and the developing roller to approach each other.

33. The color image forming device according to claim 27, wherein the inter-axis distance regulation mechanism comprises a linearly moving type inter-axis distance regulation member which is provided on one of the drum frame and the roller frame so that the regulation member is linearly movable in the multiple stages, said regulation member having a plurality of contact surface sites disposed along a linear moving direction of the regulation member so that distances of the contact surface sites from a center of the regulation member in the linear moving direction are different, and any one of the contact surface sites being in contact with a predetermined position of the other one of the drum frame and the roller frame at each of the multiple stages to thereby adjust the mutual distance between the outer peripheral surface of the developing roller and the outer peripheral surface of the photosensitive body drum in the multiple stages.

34. The color image forming device according to claim 33, wherein the drum frame and the roller frame are rotatably connected to each other so that the drum frame and the roller frame are rotated relative to each other by gravity to thereby cause the photosensitive drum and the developing roller to approach each other.

35. The color image forming device according to claim 33, wherein the drum frame and the roller frame are rotatably connected to each other and each image forming unit further comprises an urging unit which urges the drum frame and the roller frame to be rotated relative to each other to thereby cause the photosensitive drum and the developing roller to approach each other.

* * * * *